US009889494B2

(12) United States Patent
Nakamura et al.

(10) Patent No.: US 9,889,494 B2
(45) Date of Patent: Feb. 13, 2018

(54) PRESS FORMING METHOD FOR A SEMI-SOLID METAL MATERIAL AND PRESS FORMING SYSTEM FOR A SEMI-SOLID METAL MATERIAL

(71) Applicant: AIDA ENGINEERING, LTD., Kanagawa (JP)

(72) Inventors: Seiji Nakamura, Kanagawa (JP); Yuji Abe, Kanagawa (JP); Setsuo Toda, Kanagawa (JP)

(73) Assignee: AIDA Engineering Co., Ltd., Kanagawa (JP)

( * ) Notice: Subject to any disclaimer, the term of this patent is extended or adjusted under 35 U.S.C. 154(b) by 257 days.

(21) Appl. No.: 14/667,344

(22) Filed: Mar. 24, 2015

(65) Prior Publication Data

US 2015/0273566 A1 Oct. 1, 2015

(30) Foreign Application Priority Data

Mar. 31, 2014 (JP) ..... 2014-070786

(51) Int. Cl.

| | |
|---|---|
| ***B22D 18/02*** | (2006.01) |
| ***B21J 5/00*** | (2006.01) |
| ***B21J 1/06*** | (2006.01) |
| ***B22D 17/00*** | (2006.01) |
| ***C22C 1/00*** | (2006.01) |
| ***B22D 7/00*** | (2006.01) |
| ***B22D 27/02*** | (2006.01) |

(52) U.S. Cl.

CPC ..... *B21J 5/004* (2013.01); *B21J 1/06* (2013.01); *B22D 7/00* (2013.01); *B22D 17/007* (2013.01); *B22D 18/02* (2013.01); *B22D 27/02* (2013.01); *C22C 1/005* (2013.01)

(58) Field of Classification Search

CPC ..... B22D 18/02; B22D 33/00; B22D 33/02; B22D 17/007; B21J 5/00; B21J 5/004

USPC ..... 164/900

See application file for complete search history.

(56) References Cited

U.S. PATENT DOCUMENTS 6,165,411 A * 12/2000 Adachi ..... B22D 17/30 164/312
6,428,636 B2 * 8/2002 Doutre ..... B22D 17/007 148/538

(Continued)

FOREIGN PATENT DOCUMENTS

JP 08117947 A * 5/1996
JP 2003-136223 A 5/2003
JP 2003136223 A * 5/2003

(Continued)

*Primary Examiner* — Kevin E Yoon
*Assistant Examiner* — Jacky Yuen
(74) *Attorney, Agent, or Firm* — McDermott Will & Emery LLP

(57) ABSTRACT

Provided is a press forming method for a semi-solid metal material, including: manufacturing a semi-solid metal material in a container having an upward opening by injecting molten metal into the container, and cooling the molten metal while stirring the molten metal; inverting the container and storing the semi-solid metal material in a temporary storage space; discharging a liquid phase part from the semi-solid metal material through the inverting; and pressing the semi-solid metal material by feeding the semi-solid metal material, from which the liquid phase part is discharged, into dies of a pressing machine.

3 Claims, 18 Drawing Sheets

(56) References Cited

U.S. PATENT DOCUMENTS

| | | | | |
|---|---|---|---|---|
| 6,845,809 | B1 * | 1/2005 | Norville | B22D 17/007 164/113 |
| 8,241,390 | B2 * | 8/2012 | Koch | B22D 41/01 75/10.15 |

FOREIGN PATENT DOCUMENTS

| | | | |
|---|---|---|---|
| JP | 2007-118030 | A | 5/2007 |
| JP | 2011-67838 | A | 4/2011 |
| JP | 2014-18823 | A | 2/2014 |

* cited by examiner

Fig. 1A

· METAL (MOLTEN METAL) MELTED IN MELTING FURNACE IS SCOOPED UP BY MOLTEN METAL FEEDING/INJECTING DEVICE

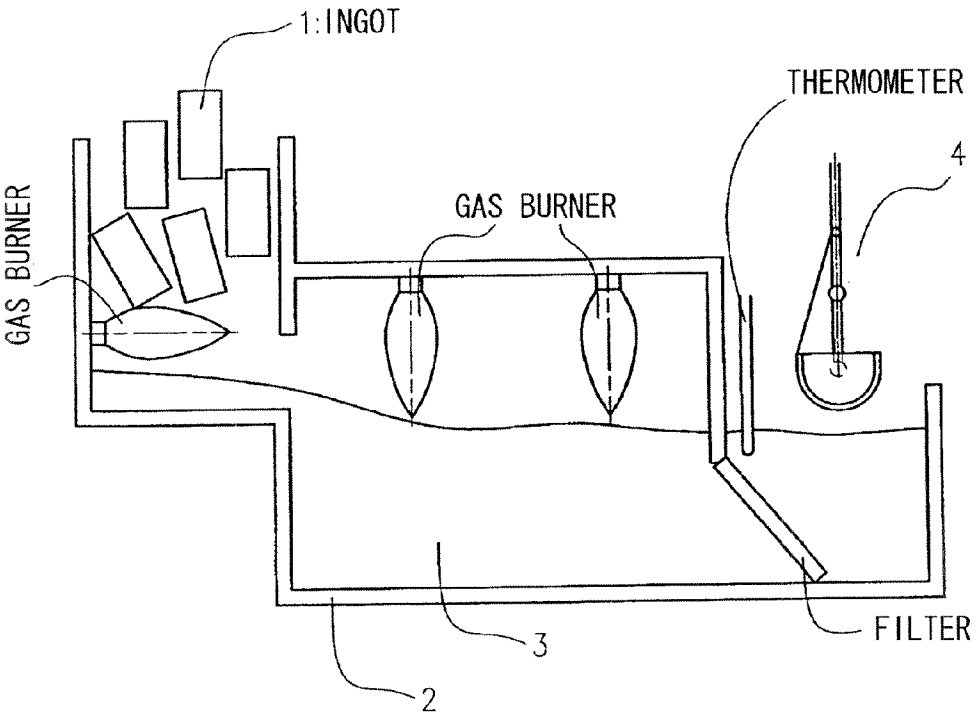

Fig. 1B

· MOLTEN METAL IS INJECTED INTO CONTAINER THROUGH FUNNEL (CONTAINER IS MADE OF NON-MAGNETIC BODY)

· ELECTROMAGNETIC STIRRING IS PERFORMED ON MOLTEN METAL BY ELECTROMAGNETIC STIRRING DEVICE FROM START OF INJECTING MOLTEN METAL

· MOLTEN METAL FEEDING PORT IS AUTOMATICALLY RETRACTED TO PREDETERMINED POSITION AFTER FINISH OF INJECTING MOLTEN METAL

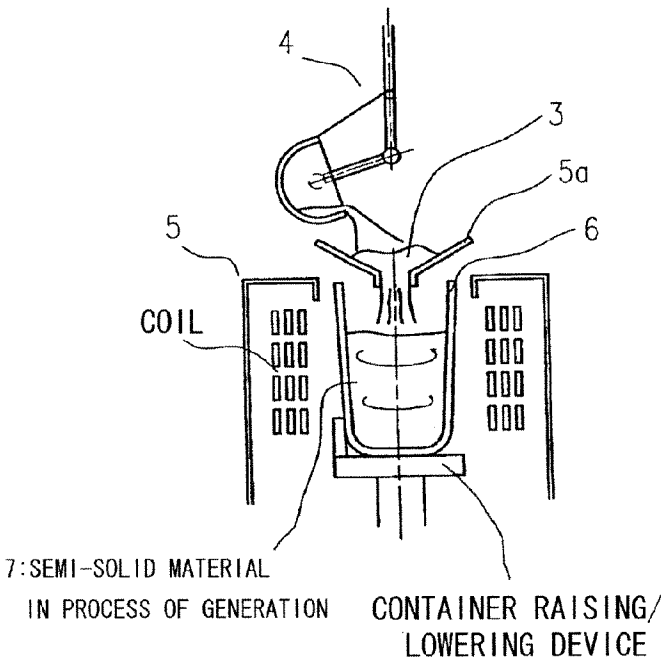

*Fig. 2*

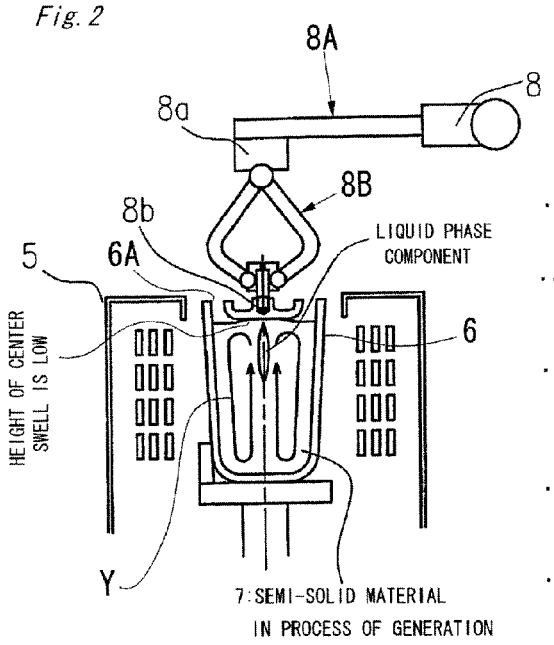

- ROBOT ARRANGES COOLING COVER IN PLACE OF RETRACTED FUNNEL AT SUBSTANTIALLY CENTER PORTION OF OPENING END OF MATERIAL.
- COOLING COVER IS DRIED, MOLD LUBRICANT (BN POWDER) IS APPLI TO MATERIAL CONTACT SURFACE, AND COOLING COVER IS HEATED AND DRIED TO 150 TO 200° C.
- PRESSURE SENSOR IS PROVIDED IN ROBOT, AND COOLING COVER IS MOVED UPWARD WHEN FORCE OF LIFTING MATERIAL UPWARD IS INCREASED TO CERTAIN MAGNITUDE OR MORE BY ELECTROMAGNETIC STIRRING.
- UPPER END SURFACE OF MATERIAL IS COOLED BY COOLING COVER. HENCE, LIQUID PHASE IS LESS LIKELY TO BE GENERATED AT OPENING END, OR GENERATED ONLY IN SMALL AMOUNT.
- COOLING COVER IS MOVED BY ROBOT ONTO DISCHARGING CONVEYOR DURING REST AFTER FINISH OF ELECTROMAGNETIC STIRRING, OR AFTER COMPLETION OF REST, AND COOLING COVER SUPPLYING CONVEYOR PREPARES TO PLACE FRESH COOLING COVER.

6a: OUTER WALL SIDE OF CONTAINER

6b: INNER WALL SIDE OF CONTAINER

9a: VERTICAL WALL PLACED ON TABLE

9b: ROBOT ARM INSERTION GROOVE

9c: VERTICAL WALL TO BE BROUGHT INTO CONTACT WITH MATERIAL

9d: VERTICAL WALL TO BE BROUGHT INTO CONTACT WITH CONTAINER

- COOLING COVER IS REMOVED AFTER FINISH OF ELECTROMAGNETIC STIRRING, AND THEN SLURRY CUP IS LIFTED ONTO ELECTROMAGNETIC STIRRING DEVICE BY CUP RAISING/LOWERING DEVICE.
- AFTER SLURRY CUP IS LIFTED, ROBOT PLACES MATERIAL PLACEMENT COVER ON SLURRY CUP.

EXAMPLE OF STATE OF REMOVING INVERTED CONTAINER

STATE IN WHICH PUSH-UP PINS ARE PUSHED UP

DESCENDING STATE OF PUSH-UP PINS

EXAMPLE OF SEMI-SOLID METAL MATERIAL INVERTING PROCESS

*Fig. 18A*

WITH COOLING COVER

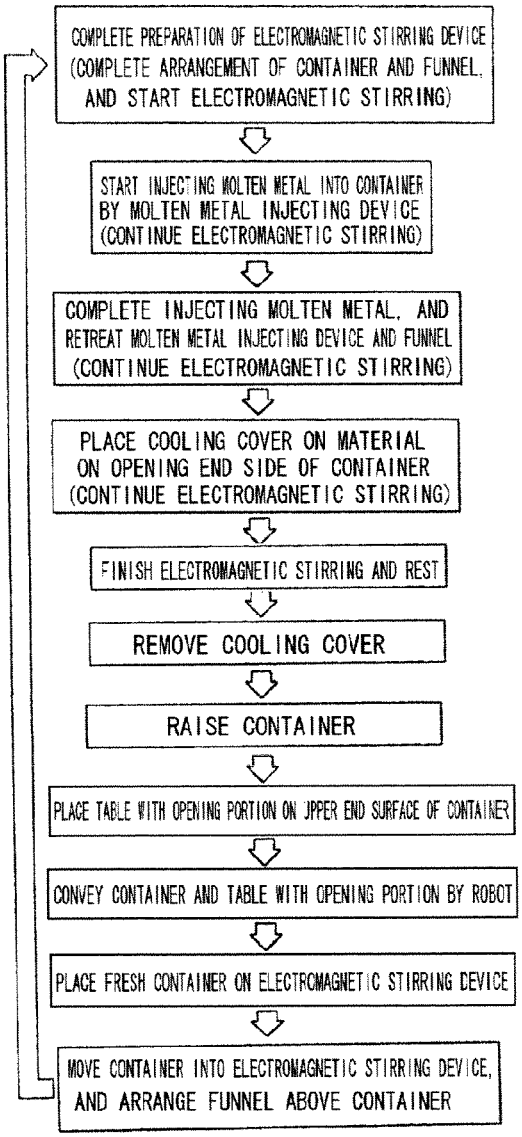

ADVANTAGES

- TEMPERATURE OF MATERIAL IN CONTAINER IS NEARLY EQUALIZED
- LIQUID PHASE IS LESS LIKELY TO BE GENERATED AT OPENING END OF MATERIAL

DISADVANTAGE

- TIME PERIOD FOR PRODUCING SEMI-SOLID MATERIAL IS INCREASED

*Fig. 18B*

WITHOUT COOLING COVER

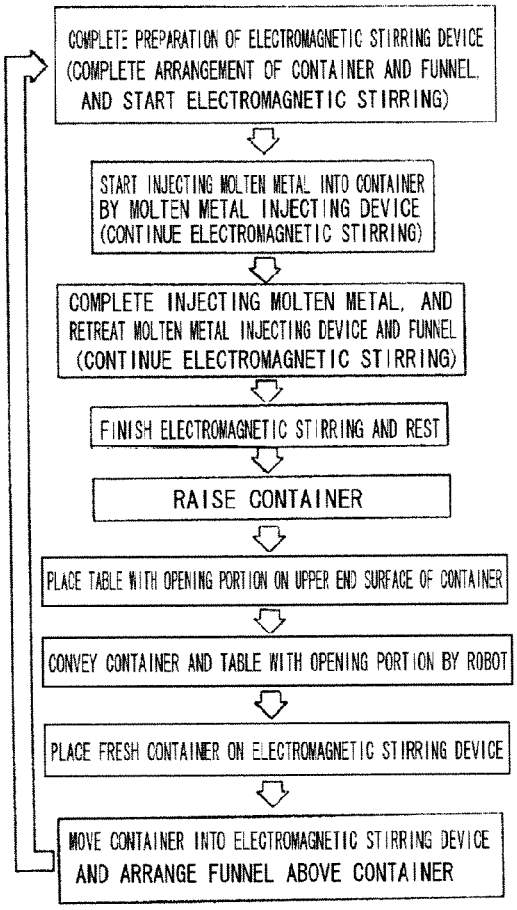

ADVANTAGE

- TIME PERIOD FOR PRODUCING SEMI-SOLID MATERIAL IS SHORT

DISADVANTAGES

- LIQUID PHASE IS LIABLE TO BE GENERATED AT OPENING END OF MATERIAL
- TEMPERATURE OF MATERIAL IN CONTAINER IS NOT EASILY EQUALIZED

PRESS FORMING METHOD FOR A SEMI-SOLID METAL MATERIAL AND PRESS FORMING SYSTEM FOR A SEMI-SOLID METAL MATERIAL

FIELD OF THE INVENTION

The present invention relates to a press forming method for a semi-solid metal material and a press forming system for a semi-solid metal material, which are configured to form mainly light metal, such as an aluminum alloy, and other kinds of metal under a semi-solid state.

BACKGROUND

Hitherto, casting has been used as a technology of forming an aluminum alloy and the like. As an example of casting methods, there has been used a die casting method, which involves injecting molten metal into a die under pressure so as to obtain a product having a predetermined shape. However, the molten metal is mainly used in the die casting method, thereby causing problems such as short lifetime of the die, and unsatisfactory quality of a product caused by generation of a shrinkage cavity or the like.

Accordingly, in recent years, as the die casting method, there has been used a casting method to be performed under high pressure using, as a metal material to be injected into the die instead of the molten metal, metal (semi-solid metal or semi-molten metal) assuming a semi-molten state in which a solid phase component and a liquid phase component coexist.

This method is distinguished from general die casting methods, and called a rheocasting method or a thixocasting method.

The rheocasting method is conducted in the following manner. Specifically, solidifying metal is forcibly stirred (or agitated) electromagnetically, mechanically, or by means of ultrasonic waves or the like, to thereby obtain semi-solid metal having a solid-liquid mixed phase in which fine spherical crystallites are dispersed homogeneously in a liquid phase. The semi-solid metal is injected under pressure into a mold of a die-cast machine, to thereby form a product by casting.

The thixocasting method is conducted in the following manner. Specifically, semi-solid metal is obtained by forcibly stirring molten metal while cooling the molten metal. Then, the semi-solid metal is temporarily cooled quickly, and then completely solidified so as to form an ingot (billet) having a bar-like shape. When manufacturing a product, a piece of a necessary amount is cut out of the billet, and then the piece is reheated so as to assume a semi-molten state (semi-solid state). Through this procedure, a product is manufactured using a die-cast machine or the like similarly to the rheocasting method.

The both methods have an advantage and a disadvantage. The both methods are common in that the semi-solid metal (hereinafter also representing the semi-molten metal) is formed under pressure in the mold.

Incidentally, when injecting the metal material into the die under pressure by the above-mentioned methods, it is necessary to set the semi-solid metal in a casting sleeve and extrude (inject) the metal into the mold by a pressure device such as a plunger. However, at a stage of inserting the semi-solid metal in the sleeve, the metal is brought into contact with the sleeve, to thereby lose its heat. Thus, a solidified layer is liable to be generated. Accordingly, an inventive way is demanded for preventing the solidified layer from being contained in a product.

Further, while filling the semi-solid metal, the sleeve or the like requires a pressure portion called a biscuit sandwiched between the plunger and a terminal end of the sleeve, a runner (sprue runner) leading the semi-solid metal into the die, and the like similarly to die casing. Further, in order to control inflow rate (reduce the inflow rate), a runner having a large cross-sectional area is required. Those portions do not form a product, thereby leading to a cause of a large amount of wasted material, reduced yield, and increased manufacturing cost.

Further, the semi-solid metal has a higher coefficient of friction with respect to the sleeve and the die than the molten metal, and hence it is necessary to increase a force of pressing the plunger as compared to a case of the molten metal. Further, it is necessary to provide a device for generating a larger force of pressing the plunger as compared to the case of the molten metal, thereby causing a problem such as increased device cost, which is a cause of increased manufacturing cost.

In view of the above-mentioned circumstances, there has been developed a forming method involving inserting the semi-solid metal (or semi-molten metal) directly into a forming die.

For example, Patent Literature 1 discloses the following technology. Specifically, semi-solid metal held in a holding vessel is inverted and placed in a recess of a lower die, and an upper die is lowered so as to compress-deform the semi-solid metal softly into a basic shape. Then, the semi-solid metal is formed into a product having a finished shape.

Further, Patent Literature 2 discloses the following method. Specifically, semi-molten metal (semi-solid metal) is charged into a cavity of a die (lower die) of a pressing machine, and an upper die is lowered. Primary forming is performed while applying pressure until a temperature of the metal in the cavity reaches a solidification finish temperature. Then, secondary forming of a product is performed by changing a shape of the cavity with a second pressure device.

Further, Patent Literature 3 discloses the following forming method. Specifically, semi-molten metal or semi-solid metal is charged into a die. First pressurizing (primary mold clamping) is performed on the die, and then second pressurizing (secondary mold clamping of forming a finished product) is performed.

Further, Patent Literature 4 discloses the following preventing method. Specifically, in order that a position of charging semi-solid metal can be corrected, the semi-solid metal is solidified so as to have a proper solid phase ratio, and thus a liquid phase component is reduced. Thus, dripping of the liquid phase component and crumble of the semi-solid metal are prevented. With this method, a satisfactory product can be obtained.

The four methods are common in that the semi-molten metal (semi-solid metal) is charged into the cavity of the die, and then pressure forming is performed.

Here, Patent Literature 1 corresponds to JP 2003-136223 A, Patent Literature 2 corresponds to JP 2007-118030 A, Patent Literature 3 corresponds to JP 2011-67838 A, and Patent Literature 4 corresponds to JP 2014-18823 A.

It is considered that, when the above-mentioned forming methods disclosed in Patent Literature 1, Patent Literature 2, Patent Literature 3, and Patent Literature 4 are used, a high-quality product having no shrinkage cavity can be manufactured at low cost using the semi-molten metal or the semi-solid metal.

Incidentally, in the method involving charging the semi-solid metal into the cavity of the die to manufacture a product under pressure, in general, in order to achieve easiness of handling of the semi-solid metal when charging the semi-solid metal into the die, and to achieve quality improvement such as reduction of a shrinkage cavity, there is used semi-solid metal that is adjusted so as to have a relatively high solid phase ratio of metal.

For example, in Patent Literature 1, the solid phase ratio of the semi-solid metal is set to 30 to 99.9%. When charging the semi-solid metal into the die, the semi-solid metal that is adjusted so as to have a predetermined solid phase ratio is contained in the vessel, and the vessel is conveyed to a position of the cavity of the die. Then, the vessel is tilted, and thus the semi-solid metal is charged (or supplied) into the cavity of the die.

However, even when the semi-solid metal is charged into the cavity of the die carefully by this inventive way, it is actually difficult to charge the semi-solid metal into the cavity of the die homogeneously and uniformly.

Patent Literature 4 describes the following matter. Specifically, when charging the semi-solid metal (molten metal) into the cavity of the die, the semi-solid metal (molten metal) falls down from a container containing molten metal (metallic container) differently each time, and hence falling positions of the semi-solid metal vary in the die. Accordingly, it is necessary to correct a charging position. Further, Patent Literature 4 describes that even correction is difficult in a case of crumbling slurry.

When the semi-solid metal (molten metal) is charged into the cavity of the die, that is, when the semi-solid metal is discharged from the metallic container, although a draft (draft angle) is formed in the metallic container and a mold lubricant is applied to the metallic container, a time period for discharging the semi-solid metal from the metallic container is not stabilized due to a wall thickness of the metallic container, variations of a molten metal injecting temperature and a molten metal injecting amount, and variations of application of the mold lubricant in a case where the semi-solid metal has a relatively high solid phase ratio, specifically, 30% to 99.9%.

Accordingly, the semi-solid metal in the metallic container is discharged in the midst of tilting the metallic container, or discharged with a certain time interval after the semi-solid metal is completely inverted. In addition, the semi-solid metal sometimes crumbles in a case where the solid phase ratio is low. There may be caused a phenomenon that the position of charging the semi-solid metal into the die is variable. Variations of the position of charging the semi-solid metal into the die cause excess and deficiency of the semi-solid metal in a portion to be filled, and actually deteriorate dimension accuracy (see Patent Literature 4).

Further, as a method of generating the semi-solid metal, the following method has been widely employed owing to its excellence in economy. Specifically, the molten metal is injected into the metallic container, and electromagnetic, mechanical, or oscillational stirring is performed while a temperature of the molten metal in the metallic container is decreased to a liquid phase temperature or less. In this manner, the semi-solid metal in which a liquid phase and a solid phase are mixed is obtained.

In this case, heat of the molten metal transfers to the metallic container from the molten metal in the metallic container, and then transfers from the metallic container to the open air. Accordingly, the temperature of the semi-solid metal contained in the metallic container is low on a side close to the metallic container in a radial direction of the metallic container, and is high on a center side of the semi-solid metal. A large amount of the liquid phase is liable to be generated at the center portion on the high-temperature side.

In a case of charging the semi-solid metal in this state, there arises a phenomenon that, when tilting the metallic container, the center portion of the semi-solid metal having a large amount of the liquid phase flows out, and then flows down first into the die. In this case, a part of the semi-solid metal having a large amount of the solid phase is charged onto a part of the semi-solid metal having a large amount of the liquid phase and having flowed down first.

When forming is performed using the material charged in this manner, the part of the semi-solid metal having a large amount of the liquid phase and having flowed in first is brought into contact with the die, and is solidified prior to the remaining part. After that, the part of the semi-solid metal having a large amount of the solid phase is formed under pressure. As a result, such a product is actually produced that the part having a large amount of the liquid phase adheres to the entire part having a large amount of the solid phase, or the liquid phase seeps through the solid phase. In this case, the product has external appearance having a heterogeneous object adhering thereto. In general, in a die-cast product, this corresponds to poor external appearance called "blister" and "seepage".

Further, in a region where only the liquid phase solidifies, as compared to the remaining region, a large number of compounds each having the liquid phase as a main component solidify and precipitate, and hence ductility is deteriorated. An outer layer portion of the product is subjected to bending deformation more intensely than an inside thereof, and hence a flex crack may start from a region where the liquid phase adheres to the outer layer and solidifies. Thus, there is also a fear of reduction in mechanical strength.

SUMMARY OF THE INVENTION

The present invention has been made in view of the above-mentioned circumstances, and has an object to provide a press forming method for a semi-solid metal material and a press forming system for a semi-solid metal material, which are capable of manufacturing uniform and high-quality products excellent in external appearance and strength while keeping productivity when the uniform and high-quality products are manufactured by a pressing machine using the semi-solid metal material.

Therefore, according to one embodiment of the present invention, there is provided a press forming method for a semi-solid metal material, including:

manufacturing a semi-solid metal material in a container having an upward opening by injecting molten metal of a metal material into the container, and cooling the injected molten metal while stirring the injected molten metal;

inverting the container containing the semi-solid metal material, and storing the semi-solid metal material in a temporary storage space;

discharging a liquid phase part from the semi-solid metal material through the inverting; and pressing the semi-solid metal material by feeding the semi-solid metal material, from which the liquid phase part is discharged, into dies of a pressing machine.

According to the one embodiment of the present invention, in the press forming method for a semi-solid metal material, the manufacturing may include cooling, when manufacturing the semi-solid metal material in the container, an upper surface side of the semi-solid metal material using a cooling cover.

According to the one embodiment of the present invention, the cooling cover may be placed in contact with the upper surface of the semi-solid metal material so as to cool at least a vicinity of a radial center portion on the upper surface side of the semi-solid metal material.

According to one embodiment of the present invention, there is provided a press forming system for a semi-solid metal material, including:

a semi-solid metal material manufacturing device for manufacturing a semi-solid metal material in a container having an upward opening by injecting molten metal of a metal material into the container, and cooling the injected molten metal while stirring the injected molten metal with a stirring device;

a semi-solid metal material inverting device for inverting the container containing the semi-solid metal material, and storing the semi-solid metal material in a temporary storage space;

a liquid phase part discharging device for discharging a liquid phase part from the semi-solid metal material through the inverting; and a pressing machine for pressing the semi-solid metal material by feeding, into dies, the semi-solid metal material from which the liquid phase part is discharged.

According to the one embodiment of the present invention, the press forming system for a semi-solid metal material may further include a device for cooling, when the semi-solid metal material manufacturing device manufactures the semi-solid metal material in the container, the semi-solid metal material under a state in which a cooling cover is held in contact with an upper surface side of the semi-solid metal material, and retracting the cooling cover after the cooling for a predetermined period of time.

According to the one embodiment of the present invention, the cooling cover may be placed in contact with the upper surface of the semi-solid metal material so as to cool at least a vicinity of a radial center portion on the upper surface side of the semi-solid metal material.

According to the one embodiment of the present invention, the semi-solid metal material inverting device may be configured to:

place a table with an opening portion on an upper end side of the container containing the semi-solid metal material in the semi-solid metal material manufacturing device; and invert together the table with an opening portion and the container containing the semi-solid metal material under a state in which the table with an opening portion is placed, to thereby place the table with an opening portion and the container in an intermediate storage space while the table with an opening portion is placed under the container.

Further, the liquid phase part discharging device may be configured to discharge, to an outside through the opening portion of the table with an opening portion, the liquid phase part of the semi-solid metal material placed on the table with an opening portion.

According to the one embodiment of the present invention, it is possible to provide the press forming method for a semi-solid metal material and the press forming system for a semi-solid metal material, which are capable of manufacturing uniform and high-quality products excellent in external appearance and strength while keeping productivity when the uniform and high-quality products are manufactured by the pressing machine using the semi-solid metal material.

BRIEF DESCRIPTION OF THE DRAWINGS

FIG. 1A is a view illustrating a state in which molten metal is scooped up from a melting furnace by a molten metal feeding/injecting device (ladle).

FIG. 1B is a view illustrating a state in which the molten metal is injected into a container in an electromagnetic stirring device. (Electromagnetic stirring is performed from the point of start of injecting the molten metal.)

FIG. 2 is a view illustrating a state in which a cooling cover is placed from an opening portion of the container so as to be brought into contact with an opening end of a semi-solid material in process of generation. (A mold lubricant (BN powder) is applied to a surface of the cooling cover to be brought into contact with the semi-solid material in process of generation, and the cooling cover is heated and dried to 150 to 200° C. The cooling cover is arranged by a robot after finish of injection of the molten metal and after retreat of a funnel, and the cooling cover is taken out during rest after finish of stirring or after completion of rest.)

FIG. 18A is a flow chart illustrating an example of procedures of producing (manufacturing) the semi-solid material according to the embodiment of the present invention, i.e., a flow chart illustrating an example of producing (manufacturing) the semi-solid material by cooling, using the cooling cover, a vicinity of a center portion of an upper portion of the semi-solid material while eliminating the liquid phase part further actively.

FIG. 18B is a flow chart illustrating an example of procedures of producing (manufacturing) the semi-solid material according to the embodiment of the present invention, i.e., a flow chart illustrating an example of producing (manufacturing) the semi-solid material without the cooling cover.

DETAILED DESCRIPTION OF THE PREFERRED EMBODIMENT

Now, a press forming method for a semi-solid metal material and a press forming system for a semi-solid metal material according to an embodiment of the present invention are described with reference to the attached drawings. Note that, the present invention is not limited to the embodiment described below.

The inventors of the present invention have made a method and a device for reducing a liquid phase component (liquid phase part), which is generated in a semi-solid metal material with a downflow characteristic, and suppressing outflow of the liquid phase component. Further, the inventors of the present invention have made a method and a device for enabling continuous work by eliminating the remaining liquid phase component, and precisely charging semi-solid metal (semi-solid material) into dies of a pressing machine.

Figure 10:
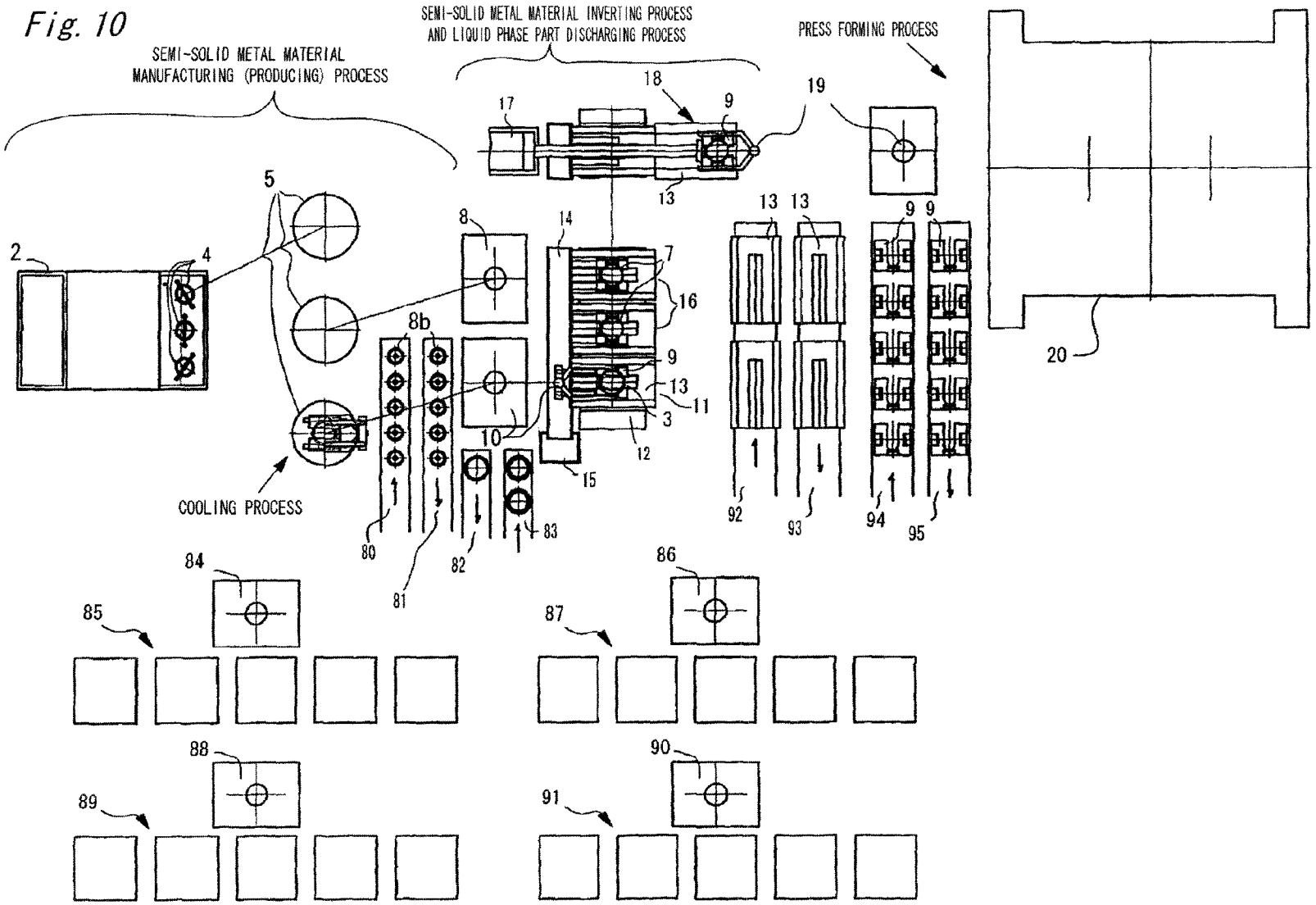
FIG. 10 is a plan view illustrating an example of a layout of an entire system according to an embodiment of the present invention.

In this embodiment, the following method is adopted. Specifically, as schematically illustrated in FIG. 10, molten metal 3 is fed from a melting furnace 2 by a molten metal feeding/injecting device 4 into a container (container having an upward opening) 6 provided in an electromagnetic stirring (or agitating) device 5, and a semi-solid material 7 is manufactured (or produced). The manufactured semi-solid material 7 is temporarily stored in an intermediate storage space 11 and an idle stage 16 (temporary storage space), and a liquid phase is eliminated (discharged) from the semi-solid material 7 during the storage. Then, using the semi-solid material 7 from which the liquid phase is eliminated, forming is performed by a pressing machine 20. In this embodiment, as a metal material for the molten metal and the semi-solid material, for example, an aluminum alloy may be employed, and another metal or another kind of alloy may also be employed.

Now, description is made in further detail.

In this embodiment, in order to produce the semi-solid material (semi-solid metal material) 7 as a material for use in press forming performed by the pressing machine 20, the electromagnetic stirring device 5 is used.

<Semi-Solid Metal Material Manufacturing (Producing) Process (Step)>

Figure 14A:
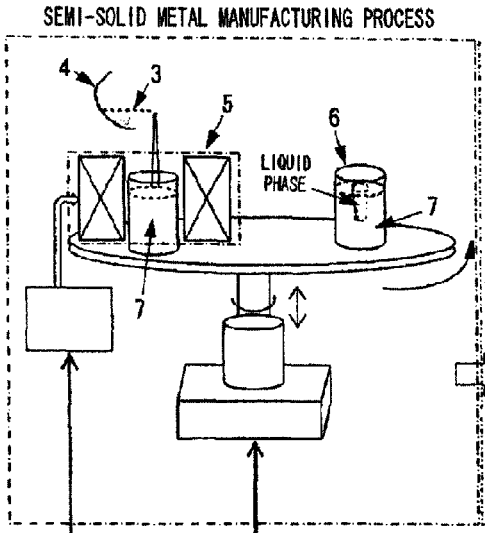
FIG. 14A is a schematic perspective view illustrating a semi-solid metal (semi-solid material) manufacturing process according to the embodiment of the present invention.

As illustrated in FIG. 1A and FIGS. 14A to 14C, the molten metal (such as an aluminum alloy) 3 scooped up from the melting furnace 2 by the molten metal feeding/injecting device (ladle) 4 is injected into the container 6 through a funnel 5*a* made of metal (for example, made of non-magnetic SUS304) by tilting the molten metal feeding/injecting device 4 as illustrated in FIGS. 1B and 14A, and the molten metal in the container 6 is cooled while the molten metal is stirred (or agitated) by the electromagnetic stirring device 5 on which the container 6 is placed. In this manner, the semi-solid material (semi-solid metal material) 7 is manufactured (obtained). (Electromagnetic stirring is performed from the point of start of injecting the molten metal.)

This process (step) corresponds to a semi-solid metal material manufacturing process (step) according to the present invention. Further, the molten metal 3, the container 6, the electromagnetic stirring device 5, and the like correspond to a semi-solid metal material manufacturing device according to the present invention.

Figure 11:
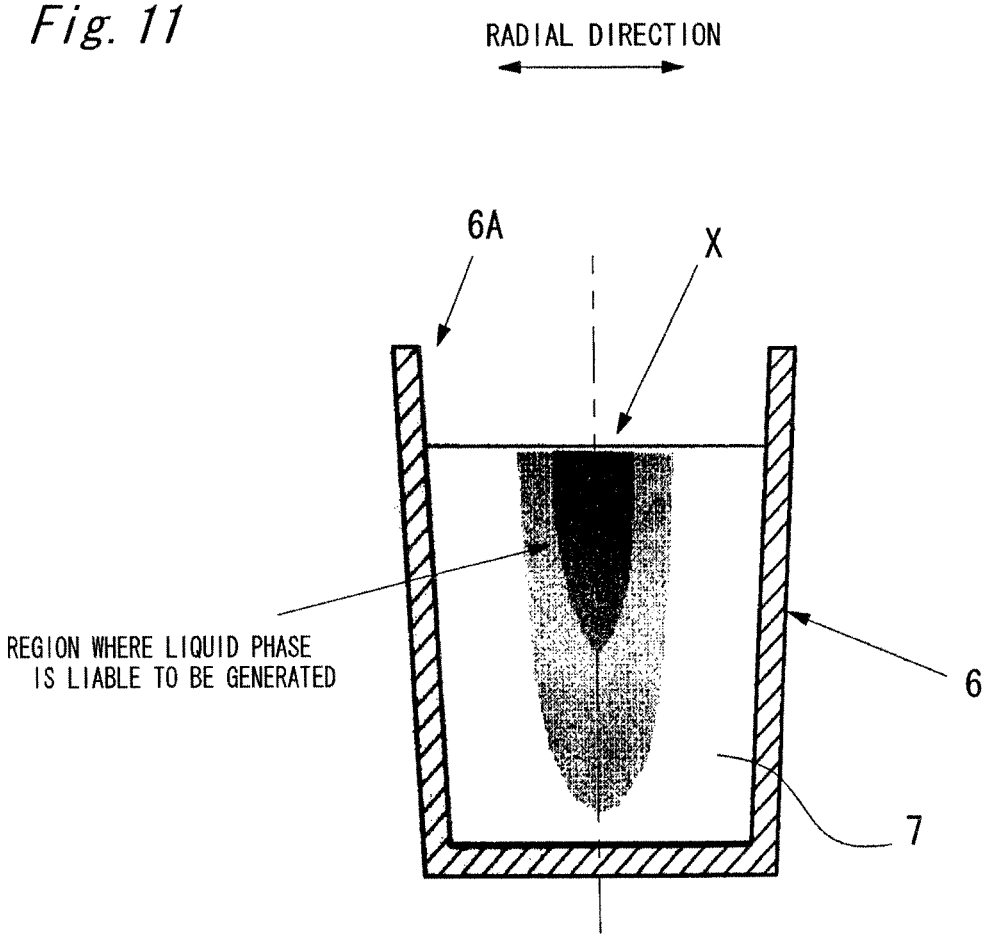
FIG. 11 is a schematic cross-sectional view illustrating a liquid phase part that may be generated in a region near a radial center portion X of the semi-solid material contained in the container according to the embodiment of the present invention.

Here, the molten metal 3 injected into the container 6 is cooled by an outer wall and a bottom of the container 6. Accordingly, as illustrated in FIG. 11, a radial center portion X of the semi-solid material 7 on an upper surface side (opening portion 6A side) most distant from the outer wall and the bottom of the container 6 has high temperature, and hence the liquid phase component, which does not assume a semi-solid state and easily flows down (or drips down), is liable to remain in the radial center portion.

In a case where a large amount of the liquid phase component remains, as described above, when the semi-solid material 7 is charged (or supplied) into the dies and formed, the liquid phase component may bring poor external appearance called "blister" and "seepage", and may precipitate on a surface of a molded product, to thereby bring reduction in strength.

<Cooling Process (Step) Using Cooling Cover>

Accordingly, in this embodiment, as a method of lowering a temperature of the radial center portion X and changing the liquid phase into the semi-solid state so as to eliminate the liquid phase, the following method is adopted. Specifically, as illustrated in FIG. 2, a cooling cover 8*b* is placed at a vicinity of the radial center portion X on the upper surface side of the semi-solid material 7 contained in the container 6 so that the cooling cover 8*b* is brought into contact with the semi-solid material 7.

This process corresponds to a cooling process (step) using the cooling cover according to the present invention.

Herein, description is made of a case where the cooling cover 8*b* is placed at the vicinity of the radial center portion X on the upper surface side of the semi-solid material 7 so that the cooling cover 8*b* is brought into contact with the semi-solid material 7, but the present invention is not limited thereto. The scope of the present invention encompasses a method employing a concept of cooling the upper surface side of the semi-solid material 7 using an element as the cooling cover.

Note that, as a material for the cooling cover 8*b*, SUS304 is adopted similarly to the non-magnetic container 6 in order to reduce an influence at the time of electromagnetic stirring. An area of the cooling cover 8*b* is set to, as an example, about 60% of an area of the upper surface side (opening portion 6A side of the container 6) of the molten metal.

Figure 14B:
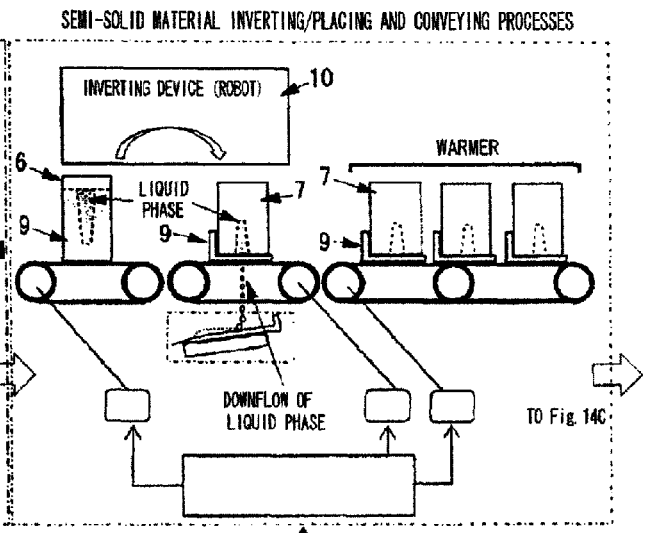
FIG. 14B is a schematic front view illustrating semi-solid material inverting/placing and conveying processes.

Note that, in a case where a small amount of the liquid phase is generated in the semi-solid material 7, and in a case where a small amount or none of the liquid phase is discharged from the semi-solid material 7 when the semi-solid material 7 is temporarily stored in the intermediate storage space 11 and the idle stage 16, as illustrated in FIGS. 14A and 14B, etc., the placement of the cooling cover 8*b* may be omitted.

FIGS. 18A and 18B are flowcharts illustrating examples of procedures of producing (manufacturing) the semi-solid material according to this embodiment. FIG. 18A illustrates an example of producing (manufacturing) the semi-solid material by cooling, using the cooling cover, a vicinity of a center portion of an upper portion of the semi-solid material while eliminating the liquid phase part further actively. FIG. 18B illustrates an example of producing (manufacturing) the semi-solid material without the cooling cover.

Operation procedure (process) of placing the cooling cover 8*b* is conducted as follows. Specifically, after injection of the molten metal as illustrated in FIG. 1B is finished and the funnel 5*a* is retreated (retracted), the cooling cover 8*b* heated to 150° C. to 200° C. and dried in advance is held and conveyed by fingers 8B mounted to a tip of an arm 8A of a robot 8, and is placed on a swell of the radial center portion of the molten metal that is being subjected to electromagnetic vertical stirring performed by the electromagnetic stirring device 5. In addition, the cooling cover 8*b* is moved to a distance of substantially a half of a height of the swell so as to push down the molten metal. Push-down load at this time is detected by a pressure sensor 8*a*, and is controlled to predetermined pressure. However, it is also possible to adopt a method of placing the cooling cover 8*b* at a vicinity of the upper surface of the semi-solid material 7.

In this case, the cooling cover 8*b*, the robot 8, and the like correspond to a part of a cooling device using the cooling cover according to the present invention.

This process is continued until completion of rest after electromagnetic vertical stirring, and the cooling cover 8*b* is taken out. Note that, the electromagnetic stirring device 5 can be configured so as to always work, for example, during operation, and to start stirring simultaneously with injection of the molten metal 3 into the container 6.

A direction of stirring the molten metal 3 (semi-solid material 7) in the container 6 by the electromagnetic stirring device 5 is as follows. Specifically, as illustrated in FIG. 2, the electromagnetic stirring device 5 forms such a vertical flow Y that the semi-solid material 7 flows in the container 6 downward from a top of an outer side of the container 6, changes the direction toward a center at a vicinity of a bottom of the container 6, and changes the direction to flow upward because flows of the semi-solid material 7 collide with each other at the center of the bottom. The electromagnetic stirring device 5 can be configured to perform stirring using the vertical flow Y.

The vertical flow Y can reduce a liquid phase region (high-temperature region) of the radial center portion X illustrated in FIG. 11, which is preferable. However, a vertical flow flowing in an opposite direction of the vertical flow Y can be also adopted. It is also assumable to make, for example, a circumferential flow for stirring. In the case of the circumferential flow, there is a fear in that the liquid phase region (high-temperature region) of the radial center portion X illustrated in FIG. 11 is increased by a centrifugal force.

However, when the cooling cover 8*b* is used, the vertical flow Y, the vertical flow flowing in the opposite direction of the vertical flow Y, and even the circumferential flow can reduce the liquid phase region formed in the radial center portion X.

As illustrated in FIG. 10, after the cooling cover 8*b* is supplied for use by a cooling cover supplying conveyor 80, the cooling cover 8*b* is released from the fingers 8B on a cooling cover discharging conveyor 81, and is discharged (carried out) by the cooling cover discharging conveyor 81. Then, the cooling cover 8*b* can be reused after undergoing water cooling, cleaning, mold lubricant application, heating, and drying.

Note that, in FIG. 10, the system includes a material feeding device 12, a container carrying-out (or discharge) conveyor 82, a container supplying conveyor 83, a robot 84, a cooling cover cleaning device 85, a robot 86, a container cleaning device 87, a robot 88, a device 89 for cleaning a table with an opening portion, a robot 90, a device 91 for cleaning an intermediate storage table, a conveyor 92 for supplying an intermediate storage table, a conveyor 93 for discharging an intermediate storage table, a conveyor 94 for supplying a table with an opening portion, and a conveyor 95 for discharging a table with an opening portion.

A temperature of a material center (radial center portion X) in the container 6 was lowered using the cooling cover 8*b* as described above. Thus, generation of the liquid phase component was able to be prevented, and a range of a solid phase ratio of the semi-solid material 7 in the container 6 was able to be set to about 40% to 55%. Note that, in the test conducted in this time, when using the cooling cover 8*b*, a large amount of a solid phase component was generated on an outer layer of the semi-solid material 7 on the upper surface side (opening portion 6A side), and it was not found that the liquid phase component flowed down when the semi-solid material was charged into the dies or stored in the intermediate storage space 11 described later.

Figure 5B:
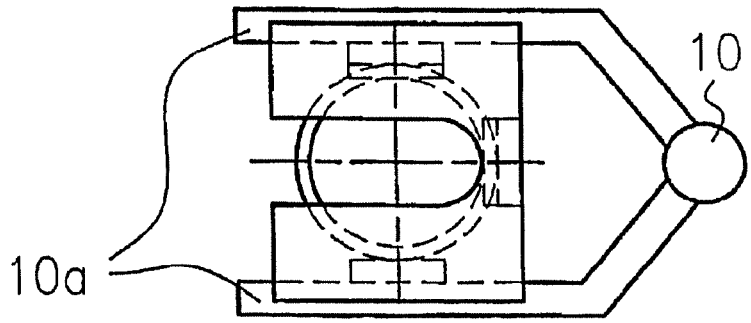
FIG. 5B is a plan view illustrating the table with an opening portion, the container, and the robot of FIG. 5A in focus.
Figure 5A:
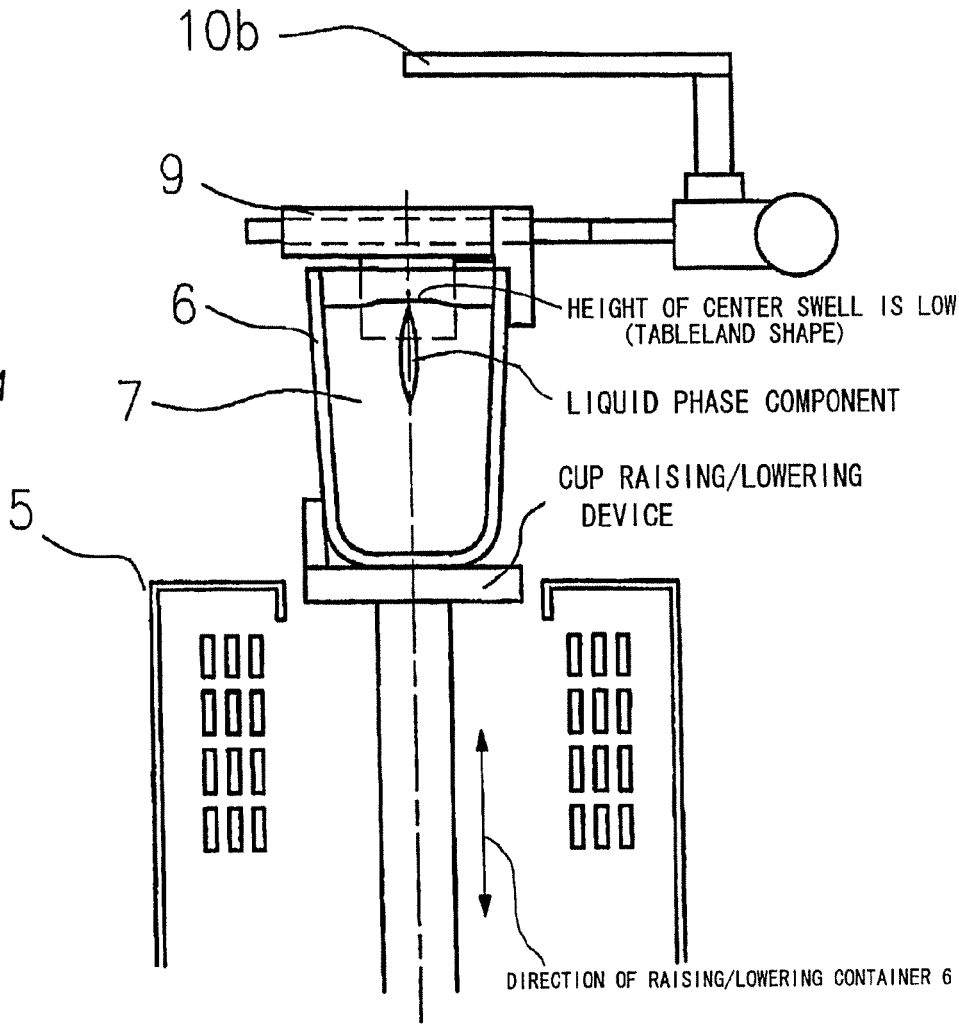
FIG. 5A is a front view illustrating a state in which the table with an opening portion is placed on an upper end surface of the container by a robot after the cooling cover is removed and the container containing the semi-solid material is pushed out above the electromagnetic stirring device by a cup raising/lowering device (container raising/lowering device).

Incidentally, in electromagnetic vertical stirring, because of the vertical flow Y, the upper surface side (opening portion 6A side) of the molten metal 3 (semi-solid material 7) in the container 6 exhibits such a shape that a vicinity of a center thereof swells. However, the swell is pressed down by the cooling cover 8*b*, and hence as illustrated in FIGS. 2 and 5A, it is possible to obtain such a tableland shape approximate to a flat shape that a height of the swell at the vicinity of the center is low.

Figure 6:
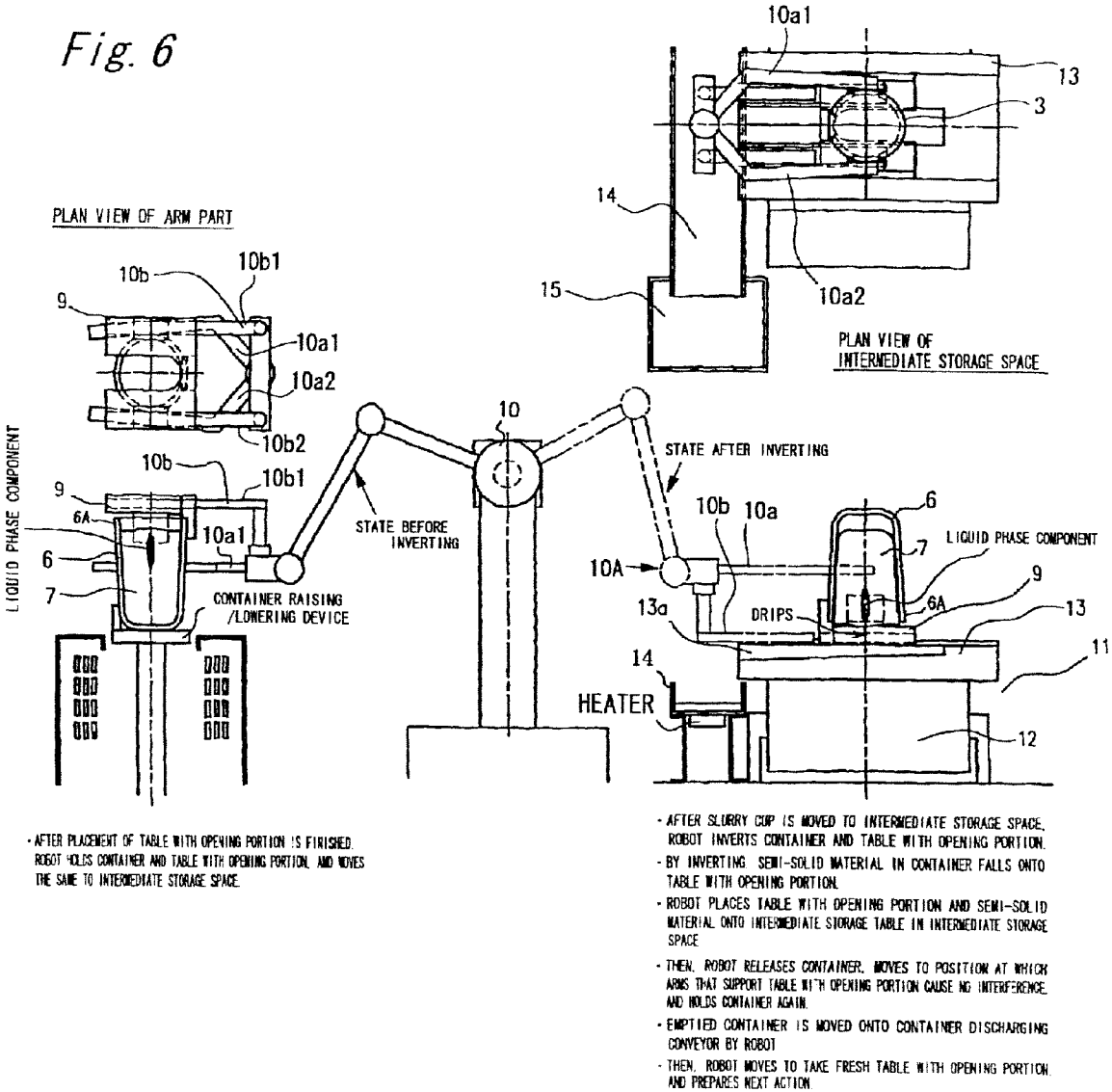
FIG. 6 is a view illustrating a state in which the robot carries the table with an opening portion and the container from the electromagnetic stirring device onto an intermediate storage space, inverts the table with an opening portion and the container on the intermediate storage space so as to separate the semi-solid material (cause the semi-solid material to fall down) from the container and place the semi-solid material on the table with an opening portion, and then carries only the container. (In a case where the semi-solid material drips at the time of inverting, through a groove formed in an intermediate storage table, the drips of the material are collected in a collecting box by a drip receiver with a heater.)

This is advantageous to enable the container 6 to be stably placed upright in a case where the upper surface side (opening portion 6A side) of the semi-solid material 7 contained in the container 6 in a state illustrated in FIG. 2 is turned upside down and the container 6 is placed upright as illustrated in a right side of FIG. 6.

Figure 3A:
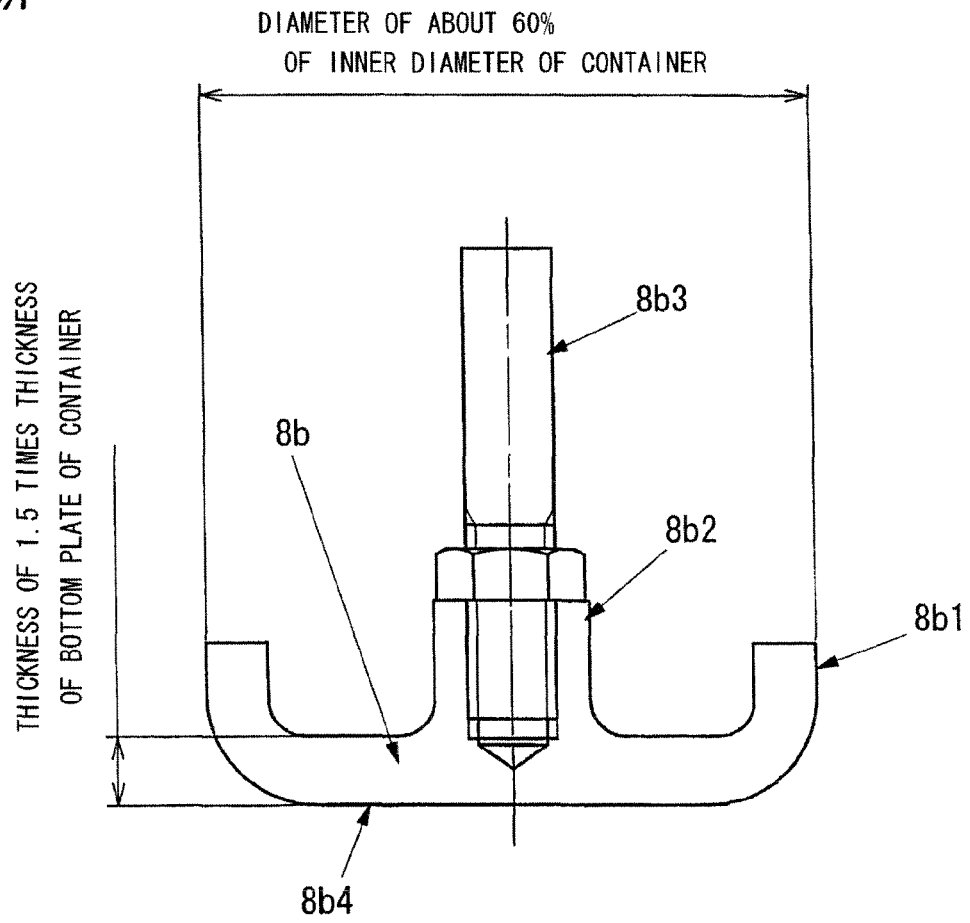
FIG. 3A is a detailed cross-sectional view illustrating the cooling cover having a disc shape.
Figure 3B:
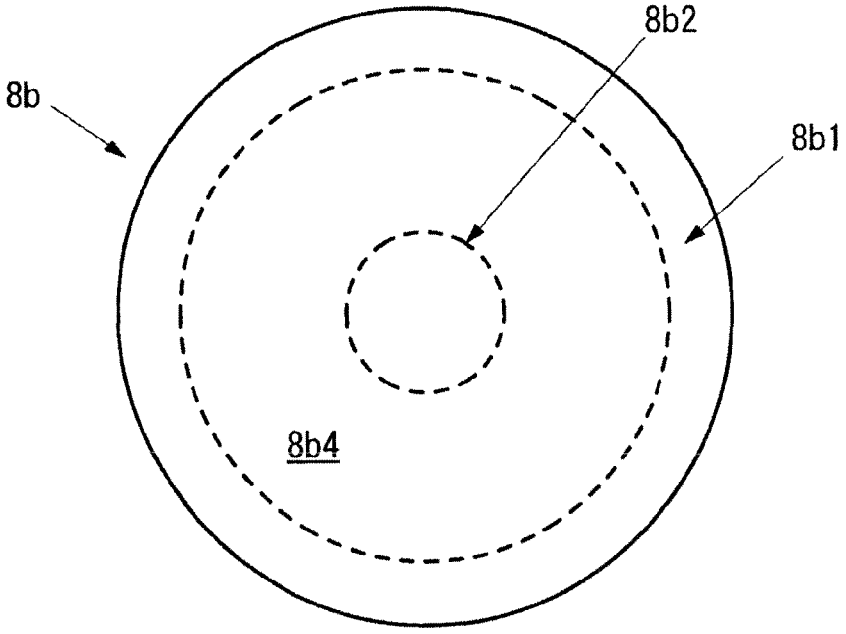
FIG. 3B is a bottom view illustrating the cooling cover of FIG. 3A.

The cooling cover 8*b* used in the test conducted in this time has the following configuration. Specifically, as illustrated in FIGS. 3A and 3B, the cooling cover 8*b* has a disc shape, and includes an upright portion 8*b*1 formed along an outer rim thereof with a height of 10 mm. A thickness of the cooling cover 8*b* is set to 1.5 times a thickness of a bottom plate of the container 6. The cooling cover 8*b* includes a boss 8*b*2 having a flat dish-like shape and including a screw provided in a center of an inner surface of the dish. The cooling cover 8*b* further includes a round bar 8*b*3 having a diameter 9 of 8 mm. The round bar 8*b*3 can be held by the fingers 8B, and is screwed into the cooling cover 8*b*.

Note that, as a matter of course, it is possible to adjust a period of time for holding the cooling cover 8*b* in contact with the semi-solid material 7 in order to adjust a degree of coolness of the liquid phase part. In addition, it is possible to select a thickness and a shape of the cooling cover 8*b* as appropriate in order to adjust heat capacity of the cooling cover 8*b* (degree of coolness of the liquid phase part), and it is also possible to select as appropriate a length, a diameter, a shape, and the like of the fingers 8B that are brought into contact with the round bar 8*b*3 and accessories of the round bar 8*b*3 and the like.

Further, the test was conducted under a state in which, similarly to the container 6, BN powder was applied to a surface 8*b*4 of the cooling cover 8*b* to be brought into contact with the semi-solid metal (semi-solid material 7). It is desired that the surface 8*b*4 of the cooling cover 8*b* to be brought into contact with the semi-solid metal (semi-solid material 7) do not allow the semi-solid metal to adhere thereto easily, and hence application of the mold lubricant and various types of surface treatments can be performed on the surface.

Note that, a shape of the cooling cover 8*b* is not limited to the above-mentioned shape. Any shapes may be adopted, such as a spherical shape, a bar-like shape, and such a cup-bottom-like shape that bar-like or conical protrusions are formed on a center portion of the bottom surface (8*b*4) so as to protrude toward the semi-solid metal (semi-solid material 7) side. Further, a shape having small undulation or unevenness that increases a surface area may be adopted in order to increase a cooling effect, but it is desired to adopt a surface shape that enables the metal material adhering to the cooling cover 8*b*, such as an aluminum alloy and a semi-solid aluminum alloy, to be removed easily.

In addition, as an advantage of using the cooling cover 8*b*, the following can be given. When using the cooling cover 8*b*, cooling performance of the container 6 is increased, and a period of time for generating the semi-solid metal can be reduced. However, depending on a size and the like of the container 6 for use, a shape, a thickness, and the like of the cooling cover 8*b* can be changed as appropriate.

Note that, in this embodiment, irrespective of whether the cooling cover 8*b* is adopted or not, when the liquid phase remains in the semi-solid material 7 while desiring, for example, reduction of a period of time for producing (generating) the semi-solid material, as illustrated in FIG. 6, the semi-solid material 7 containing the liquid phase is inverted before subjected to forming by the pressing machine 20, and the liquid phase can be discharged in the temporary storage space such as the intermediate storage space 11 and the idle stage 16 (see FIGS. 6, 7A to 7C, 10, etc.) before forming.

<Semi-Solid Metal Material Inverting Process (Step) and Liquid Phase Part Discharging Process (Step)>

Specifically, after the cooling cover 8*b* is removed from the container 6, as illustrated in FIGS. 4A to 6, under a state in which a table 9 with an opening portion is placed on an upper end side (opening portion 6A side) of the container 6 (see FIGS. 5A and 5B or a left side of FIG. 6), the container 6 is inverted by a robot 10 as illustrated in the right side of FIG. 6 and FIG. 14B. The table 9 with an opening portion has a U-shaped opening portion 9A that is formed therein and is open to a side opposite to an insertion side of arms 10*b* provided at a tip of the robot 10 (the opening portion 9A is shaped so as to enable the liquid phase component to flow down without contact when the container 6 and the semi-solid material 7 contained in the container 6 are inverted).

This process (step) corresponds to a semi-solid metal material inverting process (step) according to the present invention.

Thus, the entire semi-solid material 7 is separated from the container 6 and falls down. The container 6 is supported by a container support portion 9*d* illustrated in FIGS. 4A to 4C, whereas the semi-solid material 7 that has fallen down is supported by a material support portion 9*c* illustrated in FIGS. 4A to 4C. In this manner, the semi-solid material 7 is placed and supported on the table 9 with an opening portion, and thus prevented from falling down. However, in a case where there is a liquid phase component that is liable to be generated at the vicinity of the radial center portion X of the semi-solid material 7, only the liquid phase component is discharged downward through the opening portion 9A (see FIG. 14B, etc.).

The above-mentioned process corresponds to a liquid phase part discharging process (step) according to the present invention.

Further, in this embodiment, in order that the liquid phase can be collected and reused even when a trace of the liquid phase is discharged (flows down), as illustrated in the right side of FIG. 6, a groove 13*a* for collecting the liquid phase that has flowed down is formed in an intermediate storage table 13 of each of the intermediate storage space 11 and the idle stage 16 on which the semi-solid material 7 is inverted and placed.

Figures 7A, 7B, 7C:
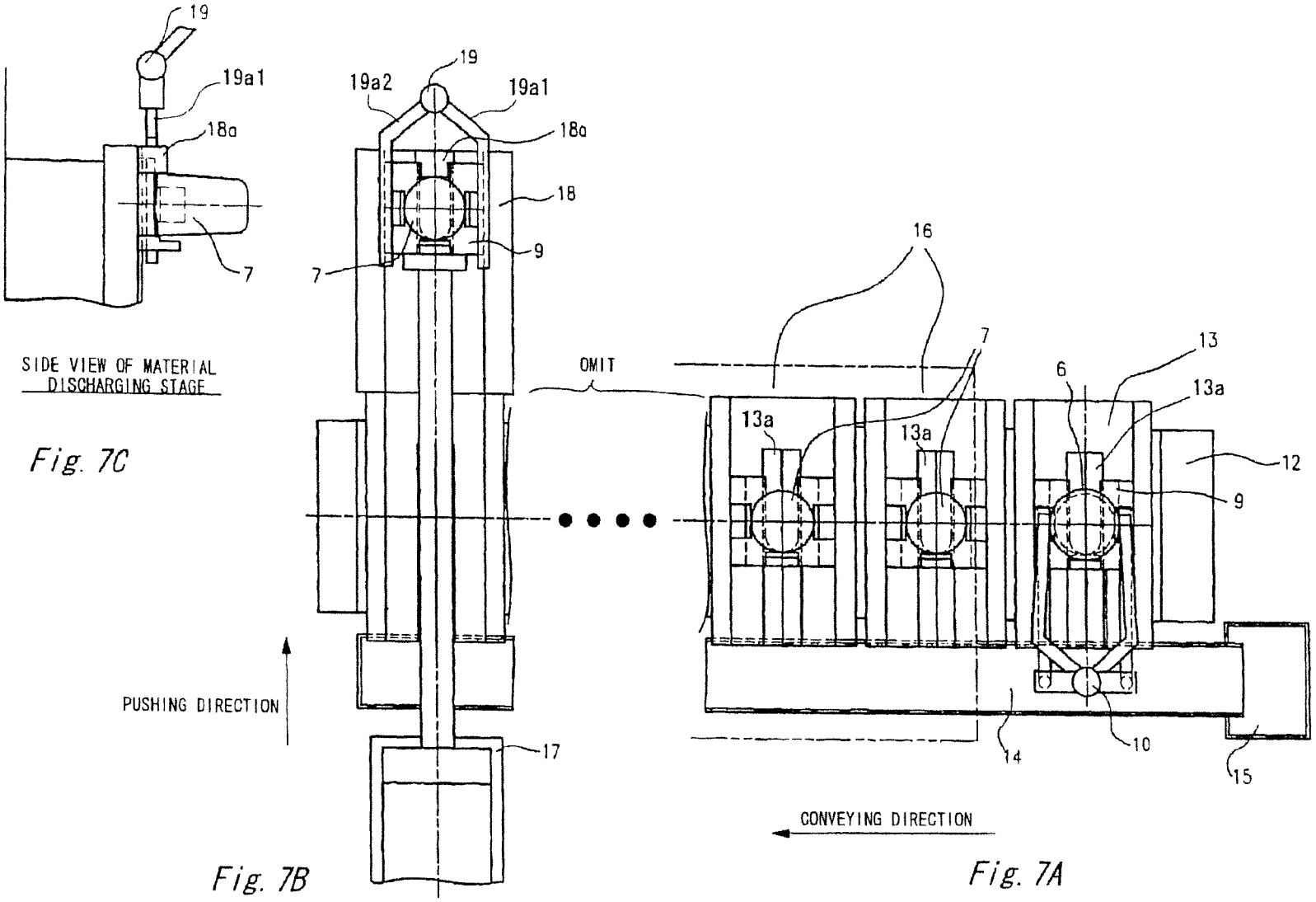
FIG. 7A is a plan view illustrating the intermediate storage space and an idle stage on which the semi-solid material is stored until the semi-solid material finishes dripping.
FIG. 7B is a plan view illustrating a state in which the semi-solid material is conveyed to a robot by a pusher for carrying out (or discharging).
FIG. 7C is a side view of FIG. 7B, for illustrating the semi-solid material carried out by the robot, and the table with an opening portion having the semi-solid material placed thereon.

Note that, as illustrated in FIGS. 7A to 7C, the liquid phase component collected by the groove 13*a* is collected by a drip receiver 14 and contained in a collecting box 15. In a case where strict control of weight of the semi-solid material 7 is desired, an amount of the liquid phase discharged from the semi-solid material 7 is monitored, and an amount of the molten metal to be injected can be increased in advance by an amount equivalent to the discharged amount.

In this case, the table 9 with an opening portion, the intermediate storage table 13 of each of the intermediate storage space 11 and the idle stage 16 serving as the temporary storage space, the groove 13*a*, and the like correspond to a part of a liquid phase part discharging device according to the present invention.

Here, as illustrated in FIGS. 7A to 7C, the semi-solid material 7 is kept on the idle stage 16 until dripping is finished. After dripping is completed, the semi-solid material 7 is sequentially conveyed to the upper side of FIGS. 7A to 7C until the semi-solid material 7 is brought into abutment on a stopper 18*a* by a pusher (such as an air cylinder) 17 in order to position the semi-solid material 7. FIGS. 7A to 7C illustrates a state in which a position of the semi-solid material 7 is adjusted on a material discharging stage 18 between the stopper 18*a* and the table 9 with an opening portion on which the semi-solid material 7 is placed, and thus the semi-solid material 7 is precisely placed on the table 9 with an opening portion. (A length of the idle stage 16 is modified depending on a size of the semi-solid material 7, and, for example, one to five idle stages 16 can be provided between the pusher 17 and a stage into which the semi-solid material 7 is carried from the intermediate storage space 11.)

The intermediate storage space 11 and the idle stage 16 (temporary storage space) according to this embodiment correspond to the liquid phase part discharging process (step) according to the present invention.

Note that, in a case where the semi-solid material 7 is cooled to a predetermined temperature or less on the idle stage 16, as illustrated in FIG. 14B, the semi-solid material 7 on the idle stage 16 can be heated by a heater (warmer) or the like.

Figure 16:
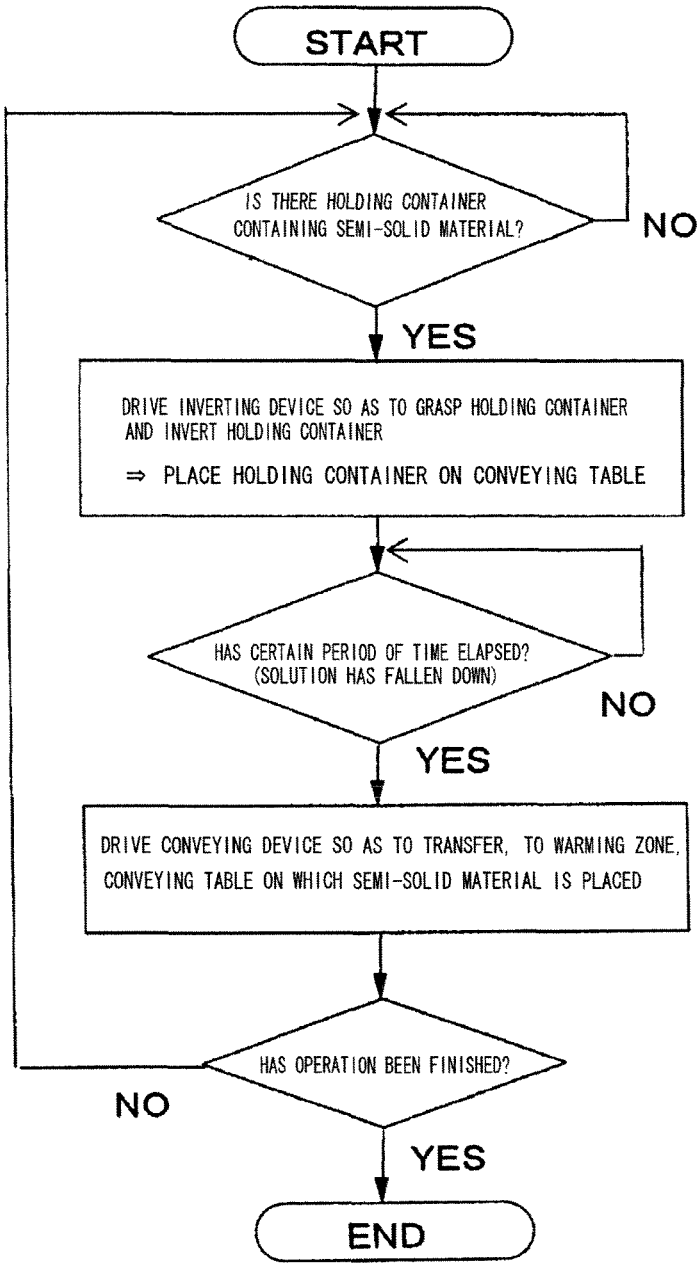
FIG. 16 is a flow chart illustrating an example of control (semi-solid metal material inverting step) in the semi-solid material inverting/placing and conveying processes illustrated in FIG. 14B.

Control in semi-solid material inverting/placing and conveying processes illustrated in FIG. 14B is exemplified in a flow chart illustrated in FIG. 16.

Figure 4B:
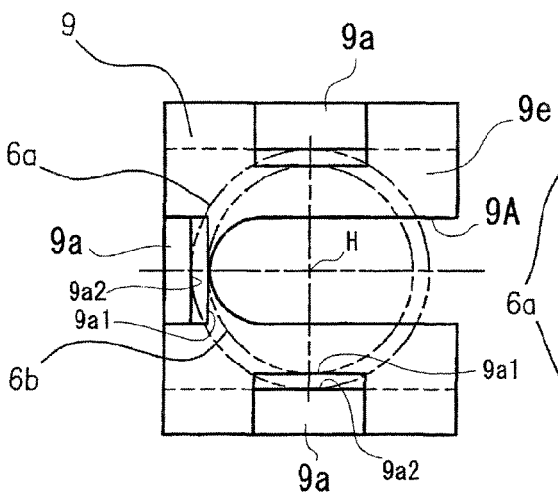
FIG. 4B is a plan view illustrating the table with an opening portion of FIG. 4A.
Figure 4C:
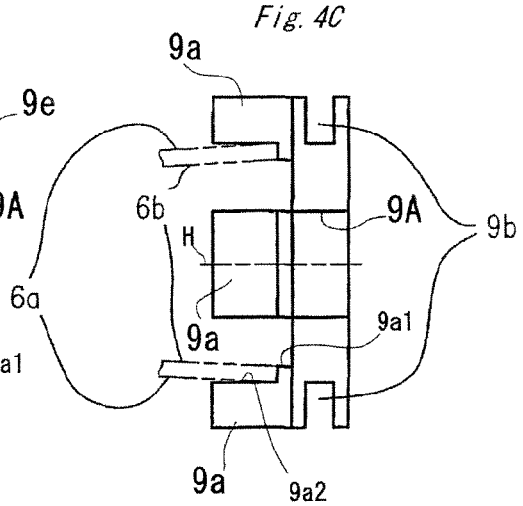
FIG. 4C is a right-hand side view illustrating the table with an opening portion of FIG. 4A.
Figure 4A:
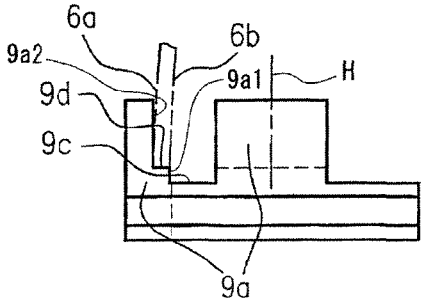
FIG. 4A is a front view illustrating an example of a table with an opening portion.

The table 9 with an opening portion according to this embodiment is used as a table on which the semi-solid material 7 is placed until the semi-solid material 7 is charged into the dies in the pressing machine 20, and hence an importance is placed on alignment accuracy between the table 9 with an opening portion and the container 6 containing the semi-solid material 7. Accordingly, in order that alignment with high accuracy can be performed easily, as illustrated in FIGS. 4A to 4C, the table 9 with an opening portion according to this embodiment includes a stopper (vertical wall 9*a*) arranged in a C-shape so as to abut on and position the container 6 from three directions.

In other words, the table 9 with an opening portion according to this embodiment includes a base portion 9*e* in which the U-shaped opening portion 9A is formed, and the stopper (vertical wall 9*a*) formed on three sides (closed side and both sides) of the base portion 9*e* except for the opening end side of the U-shaped opening portion 9A. The stopper supports the opening end of the container 6 while positioning the container 6 in a radial direction as illustrated in FIGS. 4A to 4C, 5A, and 5B when the stopper is placed on the opening end of the container 6.

Further, in the both sides of the base portion 9*e* extending in a longitudinal direction of the U-shaped opening portion 9A, there are respectively formed robot arm insertion grooves 9*b* into which arms 10*b*1, 10*b*2 of the robot 10 are inserted.

The robot 10 includes arms 10*a*1, 10*a*2 for holding the container 6. As illustrated in the left side of FIG. 6, the robot 10 integrally conveys the container 6 and the table 9 with an opening portion placed on the opening portion 6A of the container 6, and as illustrated in the right side of FIG. 6, inverts the container 6 and the table 9 with an opening portion by a joint 10A.

Through the inverting operation, the entire semi-solid material 7 contained in the container 6 is separated from the container 6 and falls down. The container 6 is supported by the container support portion 9*d* illustrated in FIGS. 4A to 4C, whereas the semi-solid material 7 that has fallen down is supported by the material support portion 9*c* (surface of the base portion 9*e* on the semi-solid material 7 side) illustrated in FIGS. 4A to 4C. In this manner, the semi-solid material 7 is placed and supported on the table 9 with an opening portion, and thus prevented from falling down. However, in a case where there is a liquid phase component that is liable to be generated at the vicinity of the radial center portion X of the semi-solid material 7, only the liquid phase component is discharged downward through the opening portion 9A.

Note that, FIGS. 4A to 4C illustrate a shape of the table 9 with an opening portion in a case where the table 9 with an opening portion is carried into the dies under a state in which a longitudinal axis H of the semi-solid material 7 extends substantially vertically. In a use case where the table 9 with an opening portion is carried into the dies under a state in which the longitudinal axis H of the semi-solid material 7 extends substantially horizontally, the table 9 with an opening portion has such a shape that a vertical wall portion 9*a*1, which is to be brought into contact with an outer periphery at a vicinity of a lower end of the semi-solid material 7, is increased in length. After the semi-solid material 7 is inverted temporarily as illustrated in the right side of FIG. 6 and the liquid phase component drips down, the table 9 with an opening portion is inclined by 90° by the robot 10 or the like, and thus the longitudinal axis H of the semi-solid material 7 can be set so as to extend substantially horizontally.

Figure 12A:
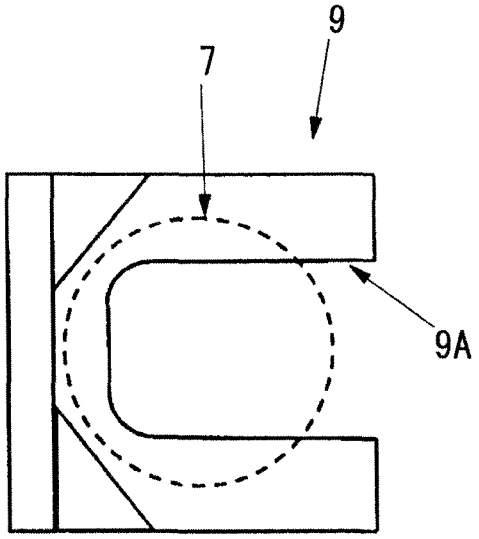
FIG. 12A is a plan view (view as seen from a direction of a surface on which the semi-solid material is placed) illustrating an example of another shape of the table with an opening portion according to the embodiment of the present invention.
Figure 12B:
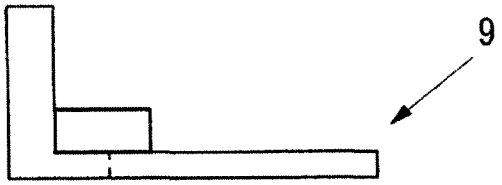
FIG. 12B is a side view illustrating the table with an opening portion of FIG. 12A.

The shape of the table 9 with an opening portion is not limited to the above-mentioned example as long as the table 9 with an opening portion has structure that enables the liquid phase component to be discharged under a state in which the semi-solid material 7 is placed on the material support portion 9*c* (surface of the base portion 9*e* on the semi-solid material 7 side), provides alignment with the container 6 with satisfactory accuracy, and does not interfere with various devices in the dies. For example, the table 9 with an opening portion can be shaped as illustrated in FIGS. 12A and 12B.

A contact surface of the table 9 with an opening portion with the semi-solid material 7 requires a material that does not quickly cool the semi-solid material 7 brought into contact with the table 9 with an opening portion, and requires a surface that prevents the semi-solid material 7 from adhering thereto. Further, the contact surface requires rigidity and strength that allow precise movement at the time of conveyance. In the test conducted in this time, a surface of the table 9 with an opening portion was made of a heat insulating material having a heat conductivity of 0.035 W/(m·K) at 600° C., which is lower than a heat conductivity of 0.06 W/(m·K) of still air. Several kinds of mold lubricants were layered and applied on a surface of the heat insulating material to be brought into contact with the semi-solid material 7.

Further, a steel material is used as a reinforcing metal material in order to ensure rigidity and accuracy at the time of conveyance, and the table 9 with an opening portion has a cutout and a groove formed therein for use in carrying, charging, and alignment with a moving device, a charging device, and the dies.

Figure 13:
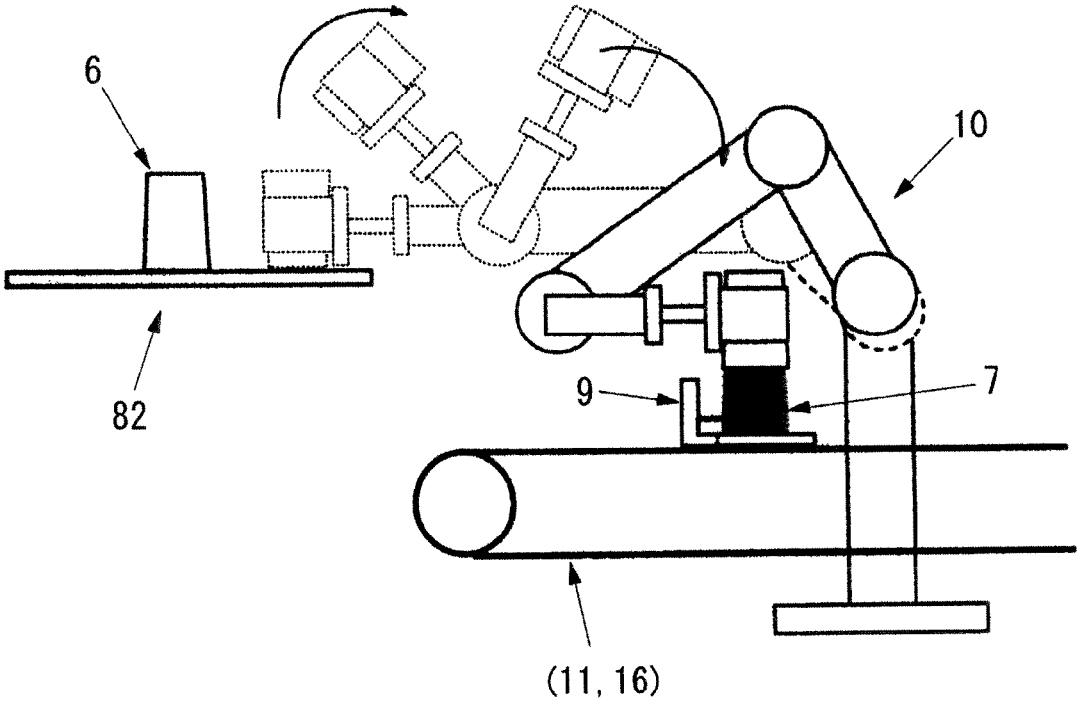
FIG. 13 is a front view illustrating an example of a state in which only the container is removed by the robot under a state in which the container containing the semi-solid material is inverted, and the removed container is carried out onto a container discharging conveyor.

As illustrated in FIG. 6, the robot 10 inverts (by rotating the joint 10A) the container 6 containing the semi-solid material 7, and places the container 6 upright on the intermediate storage table 13 so as to turn upside down the upper end side (opening portion 6A side) of the container 6. Then, the robot 10 releases the distal arms 10*a*, 10*b* (increases an interval between the arms 10*a*1, 10*a*2, and increases an interval between the arms 10*b*1, 10*b*2), and starts an action of pulling the distal arms 10*b* out of the table 9 with an opening portion on the intermediate storage table 13. After the distal arms 10*a* are retracted from the robot arm insertion grooves 9*b* of the table 9 with an opening portion and moved to a position at which there is no obstruction even if the distal arms 10*a* swing (see chain double-dashed lines indicating the respective arms of the robot 10 in the right side of FIG. 6), the robot 10 narrows the distal arms 10*a* (decreases the interval between the arms 10*a*1, 10*a*2), and thus holds only an outer side of the container 6 by the distal arms 10*a*. Then, as illustrated in FIGS. 10 and 13, only the container 6 is removed under a state in which the semi-solid material 7 is placed on the table 9 with an opening portion, and the container 6 is carried out onto the container carrying-out conveyor 82, thereby being delivered to a waiting space for cleaning.

After the table 9 with an opening portion having the semi-solid material 7 placed thereon is placed on the intermediate storage space 11, as illustrated in FIGS. 7A to 7C, the table 9 with an opening portion is sequentially conveyed to a tail end of the idle stage 16 while preparing the semi-solid state of the semi-solid material 7, and is conveyed by the pusher 17 onto the material discharging stage 18 on a robot 19 side.

The table 9 with an opening portion, which is conveyed onto the material discharging stage 18 on the robot 19 side with the semi-solid material 7 being placed thereon, can be precisely positioned from four directions by the stoppers (by the C-shaped vertical wall 9*a* of the table 9 with an opening portion from three directions and by the stopper 18*a* on the robot 19 side).

<Press Forming Process (Step)>

Figure 14C:
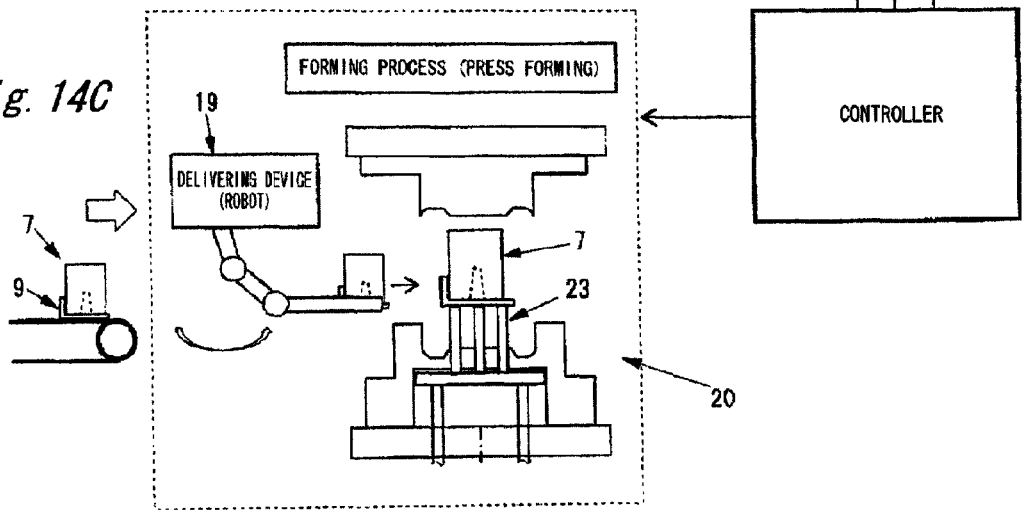
FIG. 14C is a schematic front view illustrating a forming process (press forming).

The robot 19 inserts distal arms 19*a* (19*a*1, 19*a*2) into the robot arm insertion grooves 9*b* formed in the both sides of the table 9 with an opening portion on which the semi-solid material 7 is placed, and thus the robot 19 transfers the table 9 with an opening portion, on which the semi-solid material 7 is placed, into dies in the pressing machine 20 (see FIG. 14C, etc.).

Figure 17:
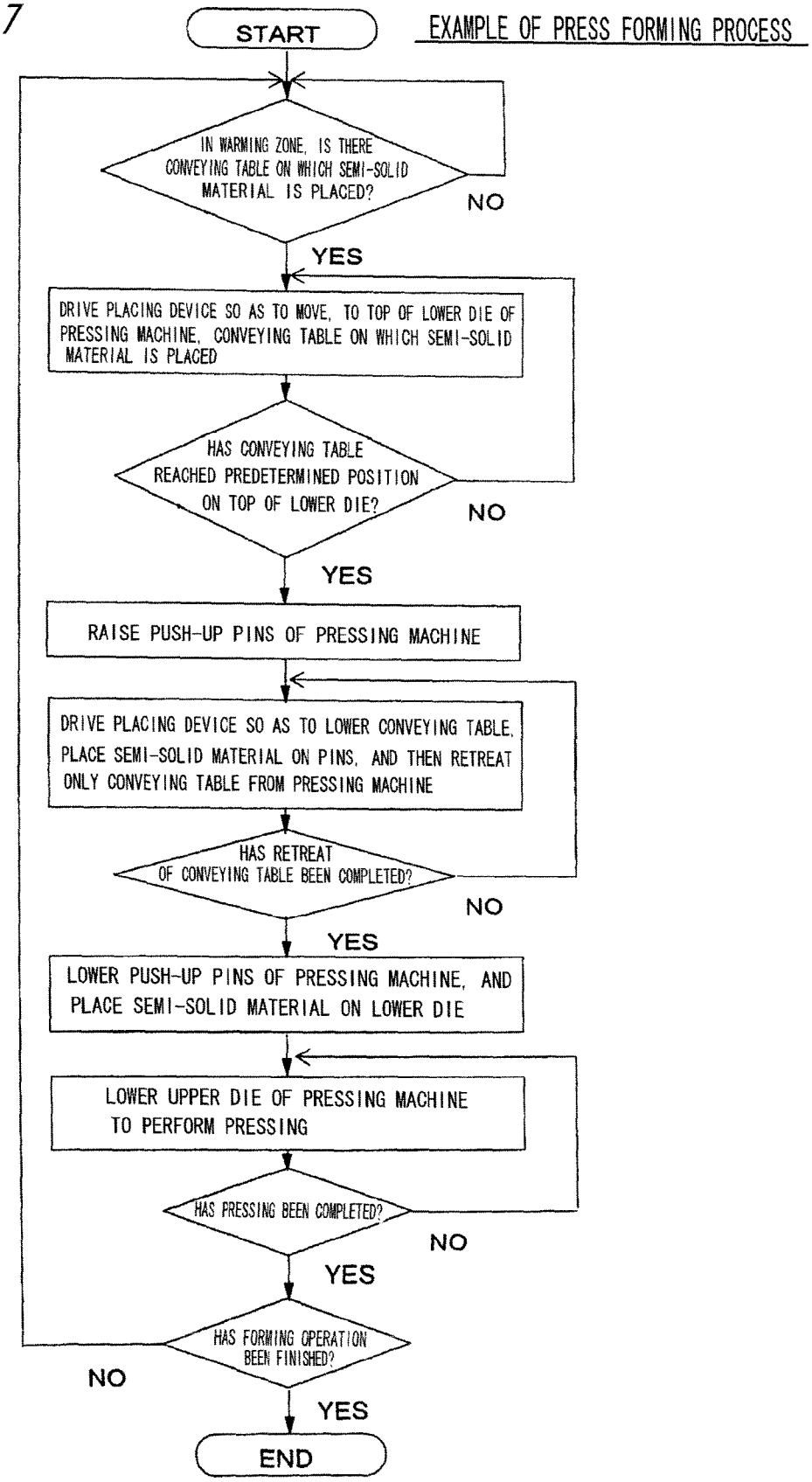
FIG. 17 is a flow chart illustrating an example of control (press forming step) in a forming process (press forming) illustrated in FIG. 14C.

Note that, FIG. 17 illustrates an example of a flow chart of control in a forming process (press forming) illustrated in FIG. 14C.

Figure 8:
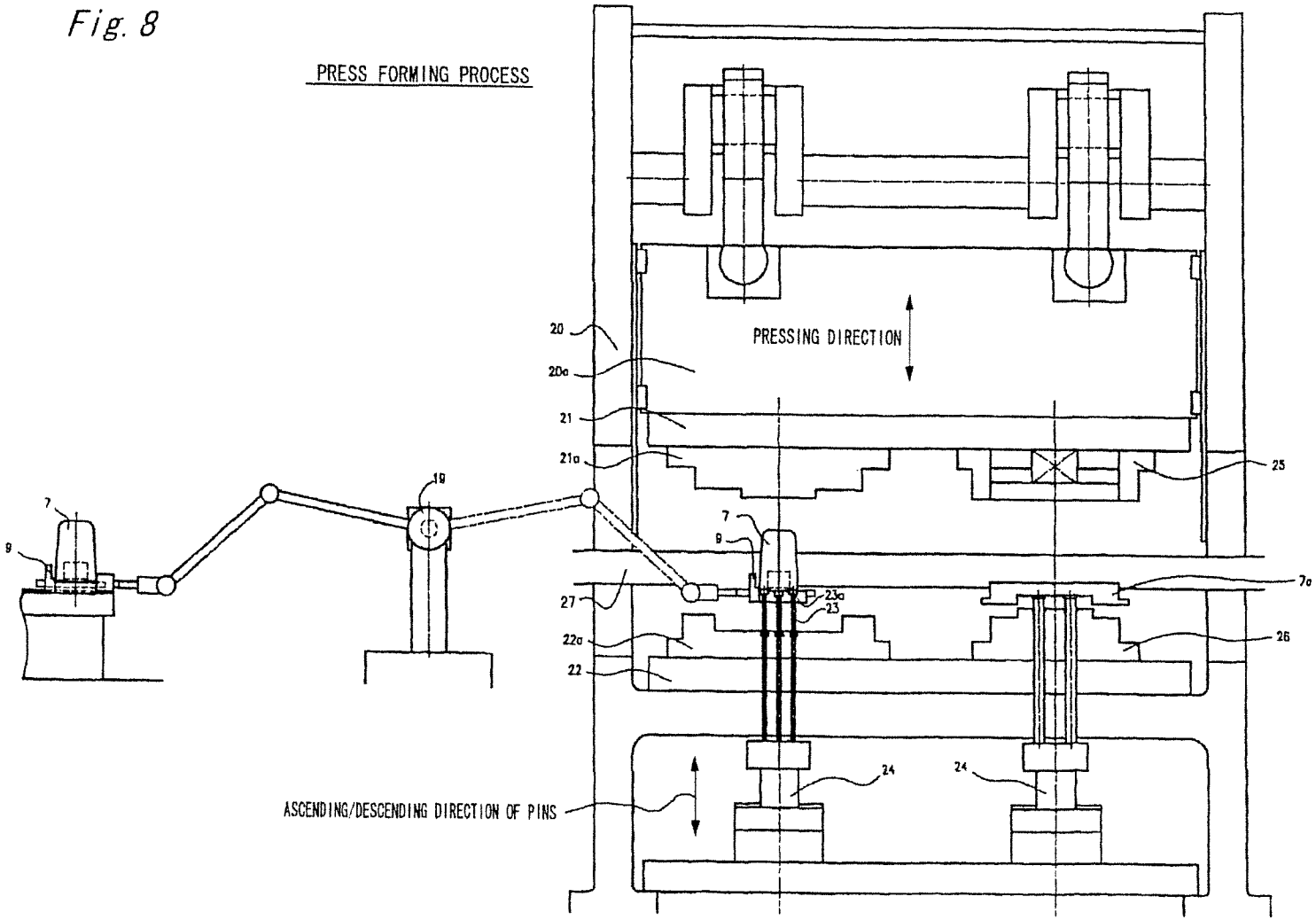
FIG. 8 is a front view illustrating a state in which the robot receives the semi-solid material from a material discharging stage, and charges the semi-solid material into dies in a pressing machine serving as a forming stage.

Here, FIG. 8 illustrates a state in which the robot 19 charges the semi-solid material 7 from the material discharging stage 18 into first-process dies 21, 22 provided in the pressing machine 20. Note that, the semi-solid material 7*a* formed in a first process (by the first-process dies 21, 22) is conveyed in a second process (into second-process dies 25, 26) by a transfer device 27 provided in the pressing machine 20, and a product obtained after finish of the second process is carried out of the pressing machine 20 (state illustrated in FIG. 8).

At this time, in this embodiment, extruding pins (push-up pins) 23 for releasing the product (pins for extruding the product from the dies after forming) are placed in the dies. Strokes of the extruding pins (push-up pins) 23 in a lower die 22*a* are extended on a parting surface up to such a height considering a tooling allowance of the transfer device 27 (for carrying out the product obtained after forming), and the semi-solid material 7 is placed on the extruding pins 23.

After that, the extruding pins (push-up pins) 23 are lowered, and thus the semi-solid material 7 is fed into the lower die 22*a* softly.

In a case where the semi-solid material 7 is used under a state in which a center axis of the semi-solid material 7 extends horizontally, the container 6 is removed under a state in which the semi-solid metal is placed on the table 9 with an opening portion (until this, steps progress similarly to the case illustrated in FIGS. 6 and 13). Then, the table 9 with an opening portion is moved to a laying device while the semi-solid material 7 is placed on the table 9 with an opening portion, and the table 9 with an opening portion is inclined by substantially 90° by the laying device so that the center axis of the semi-solid material 7 is directed horizontally. Thus, the semi-solid material 7 is shifted onto a side wall table (not shown) provided below the vertical wall 9*a* (side wall) of the table 9 with an opening portion inclined by substantially 90° from a horizontal posture, and then the table 9 with an opening portion is retracted.

Note that, the side wall table can have a surface, on which the semi-solid material 7 is to be placed, formed into a U-shape along a side surface of the semi-solid material 7, and a cutout, a groove, and the like enabling conveyance and alignment by the robot 19 and the like can be formed in the side wall table similarly to the table 9 with an opening portion. In addition, similarly to the table 9 with an opening portion, the side wall table can be configured to avoid interference with the extruding pins 23.

Also in a case of the side wall table, similarly to the case of the table 9 with an opening portion, as illustrated in FIG. 8, the semi-solid material 7 is placed on the extruding pins 23 in the lower die 22*a* after conveyed from a position at which the semi-solid material 7 is picked up by the robot 19 or the like (from the material discharging stage 18 illustrated in FIG. 10), and the table 9 with an opening portion (or the side wall table) is discharged by the robot 19 or the like onto a releasing position (conveyor 95 for discharging a table with an opening portion illustrated in FIG. 10). Note that, the table 9 with an opening portion and the side wall table may be formed integrally, but also may be formed separately.

Incidentally, the extruding pins 23 form a part of the lower die 22*a* when the pressing machine 20 performs forming. Accordingly, forming load is applied to the extruding pins 23 by magnitude equivalent to a cross-sectional area of a pin (area of a cross-section taken along a direction substantially orthogonal to the longitudinal direction), and it is desired to prevent quick cooling of the semi-solid material 7 with which the extruding pins 23 are brought into contact. Therefore, tips 23*a* of the extruding pins 23 can be made of, for example, zirconia as a material having a small heat transfer coefficient and satisfactory strength.

Note that, the pressing machine 20 includes a pin raising/lowering piston 24.

Note that, a cross-section of the extruding pins 23, which is taken along a direction orthogonal to a longitudinal axis direction of the extruding pins 23 placed in the first-process lower die 22*a* in advance, may be formed into a cylindrical shape or a rectangular parallelepiped shape.

After the semi-solid material 7 is placed on the extruding pins 23, the table 9 with an opening portion (or the side wall table), the robot 19, and the like are retracted out of the dies in the pressing machine 20, and at the same time, the extruding pins 23 are lowered. Directly after that, a first-process upper die 21*a* is depressed to conduct press forming.

This process corresponds to a press forming process (step) according to the present invention.

The table 9 with an opening portion (or the side wall table) after feeding the semi-solid material 7 into the pressing machine 20 is carried out by the robot 19 onto the conveyor 94 for supplying a table with an opening portion and the conveyor 95 for discharging a table with an opening portion illustrated in FIG. 10, and then transferred to a predetermined position close to the container 6 on a semi-solid material generating device (electromagnetic stirring device 5). In a case where there is an extraneous matter on a surface of the table 9 with an opening portion, the extraneous matter is removed, and it is confirmed that the table 9 with an opening portion has no extraneous matter. Then, the table 9 with an opening portion is reused for a next container 6.

Figure 9:
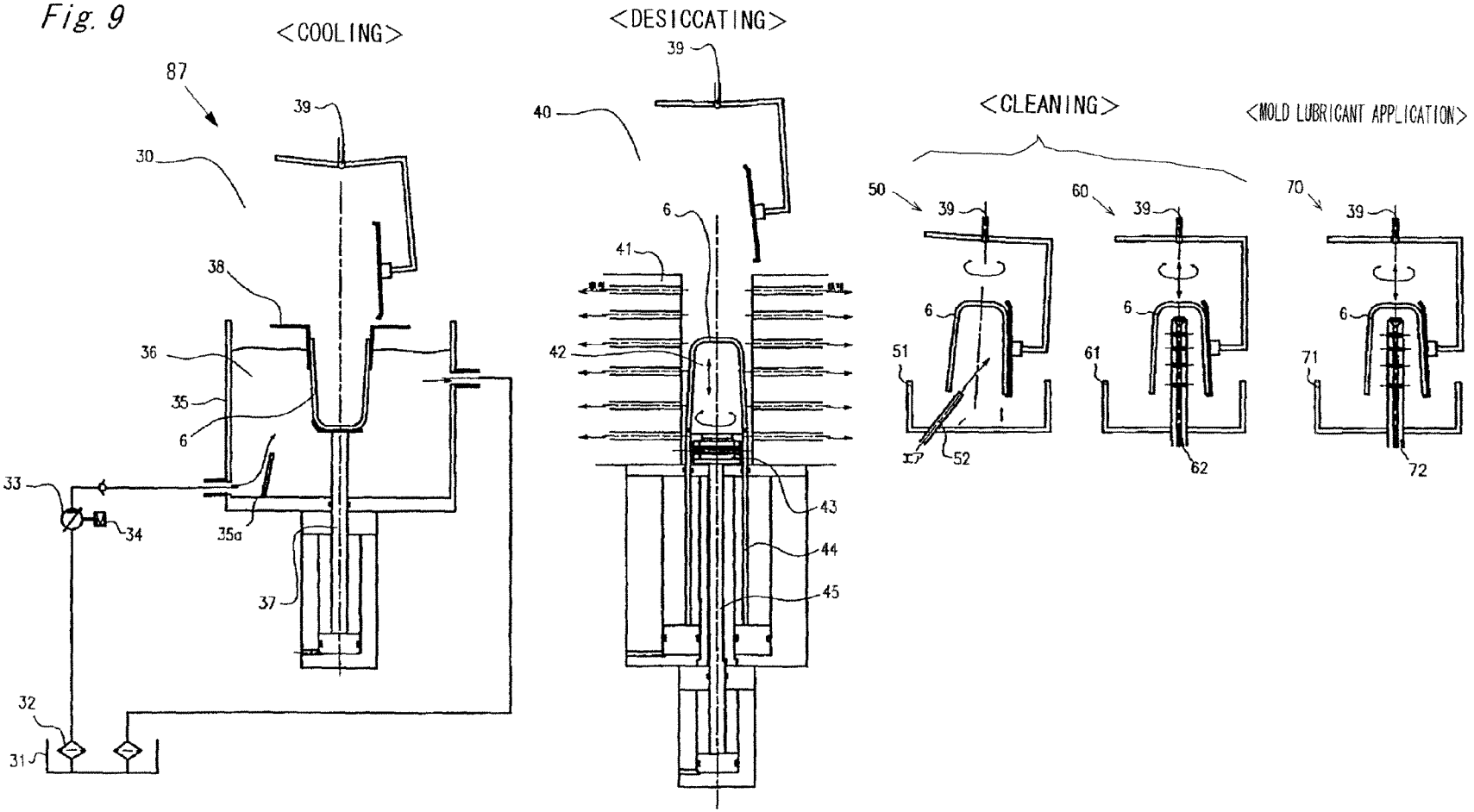
FIG. 9 is a front view illustrating a state in which, in order to reuse the container after use (used container), the container is sequentially subjected to the processes of cooling, desiccating, cleaning, and mold lubricant application while conveyed by the robot. (The cooling cover can also be reused in a similar way.)

As illustrated in FIG. 9, the container 6 after use (used container) is conveyed by a robot 39 for reuse, and is sequentially subjected to the processes of cooling (container cooling process 30), desiccating (container desiccating process 40), cleaning (rough container cleaning 50 and container cleaning 60), and mold lubricant application (process 70 of applying the mold lubricant on the container) in the stated order. (The cooling cover 8*b* is also reused in a similar way.)

In FIG. 9, the system includes a tank 31, a filter 32, a pump 33, a motor 34, a cooling water tank 35, a baffle 35*a*, cooling water 36, a container raising/lowering piston 37, a cooling water spatter preventing plate 38, a container desiccating machine 41, a container retainer 42, a rotary actuator 43, a container raising/lowering piston 44, a raising/lowering piston 45 at the time of desiccating the container, a residue receiver 51, an air supplying nozzle 52, a residue receiver 61, an air supplying nozzle 62, a mold lubricant receiver 71, and a mold lubricant feeding nozzle 72.

Note that, FIGS. 15A to 15D illustrate on a time-series basis a state in which forming is performed by the dies in the pressing machine 20 according to this embodiment.

Figure 15A:
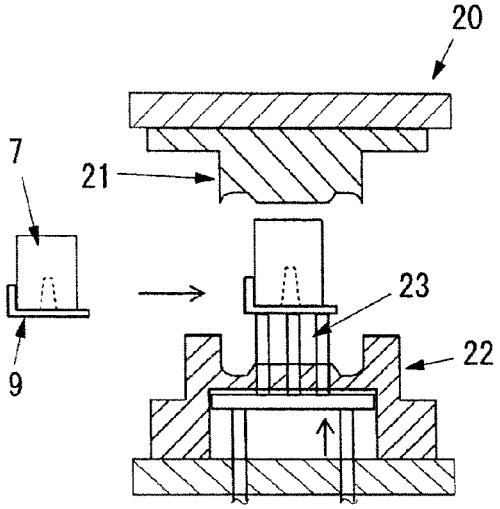
FIG. 15A is a front view illustrating a state in which the table with an opening portion, on which the semi-solid material is placed, is brought onto extruding pins protruding from a lower die.

FIG. 15A illustrates a state in which the table 9 with an opening portion, on which the semi-solid material 7 is placed, is brought onto the extruding pins 23 protruding from the lower die 22.

Figure 15B:
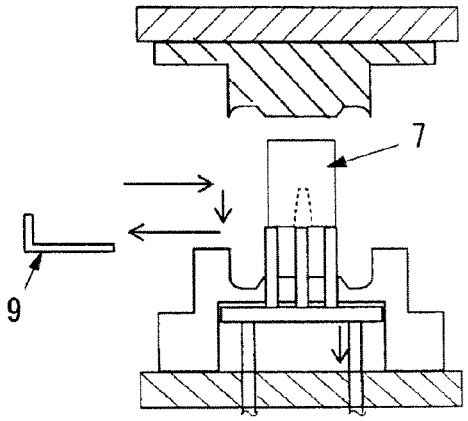
FIG. 15B is a front view illustrating a state in which the table with an opening portion that has delivered the semi-solid material to the extruding pins is retracted from the pressing machine.

Then, as illustrated in FIG. 15B, the table 9 with an opening portion that has delivered the semi-solid material 7 to the extruding pins 23 is retracted from the pressing machine 20.

Figure 15C:
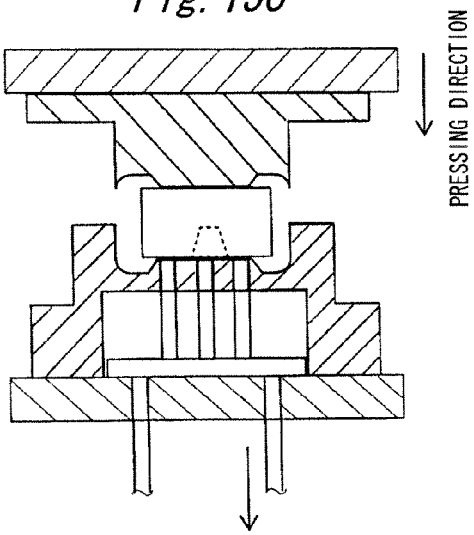
FIG. 15C is a front view illustrating a state in which the extruding pins put the semi-solid material into the lower die while descending, whereas an upper die descends to start press forming.

Next, as illustrated in FIG. 15C, the extruding pins 23 put the semi-solid material 7 into the lower die 22 while descending, and at the same time, the upper die 21 descends to start press forming.

Figure 15D:
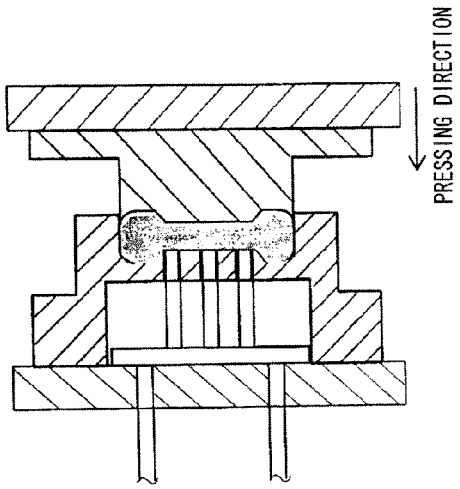
FIG. 15D is a front view illustrating a state in which the lower die and the upper die perform press forming on the semi-solid material.

FIG. 15D illustrates a state in which the lower die 22 and the upper die 21 perform press forming on the semi-solid material 7.

As described above, according to this embodiment, press forming is performed by the pressing machine using the semi-solid metal material, and thus uniform and high-quality products can be manufactured. However, when manufacturing (producing) the semi-solid metal material, the semi-solid metal material is inverted, and thus the liquid phase part is eliminated. In this manner, it is possible to solve problems of the related art, such as poor external appearance called "blister" and "seepage", and reduction in strength. Accordingly, while keeping productivity such as yield high, it is possible to manufacture uniform and high-quality products that are more excellent in external appearance and strength than the related-art products.

Further, in this embodiment, in the process of manufacturing (producing) the semi-solid metal material, before the semi-solid metal material is inverted, the liquid phase part is actively cooled by the cooling cover, and thus the liquid phase part is eliminated further reliably. Accordingly, while further keeping productivity such as yield high, it is possible to manufacture uniform and high-quality products excellent in external appearance and strength.

That is, according to this embodiment, it is possible to provide the press forming method for a semi-solid metal material and the press forming system for a semi-solid metal material, which are capable of manufacturing uniform and high-quality products excellent in external appearance and strength while keeping productivity when the uniform and high-quality products are manufactured by the pressing machine using the semi-solid metal material.

Note that, this embodiment exemplifies a case where stirring is performed using the electromagnetic stirring device 5, but the present invention is not limited thereto. The present invention is also applicable to a case where the molten metal 3 is cooled while stirred by another method in order to produce the semi-solid material 7.

The embodiment described above is merely an example for describing the present invention. It goes without saying that various modifications may be made without departing from the gist of the present invention.

What is claimed is:

1. A press forming system for a semi-solid metal material, comprising:

a semi-solid metal material manufacturing device for manufacturing a semi-solid metal material in a container having an upward opening by injecting molten metal of a metal material into the container, and cooling the injected molten metal while electromagnetically stirring the injected molten metal with a stirring device;

a semi-solid metal material inverting device having a robot arm to hold the container containing the semi-solid metal material, and invert the container to place the container in a temporary storage space;

a liquid phase part discharging device including a table with an opening through which a liquid phase part is discharged from the semi-solid metal material, the container being held by the robot arm; and a pressing machine for pressing the semi-solid metal material by feeding, into dies, the semi-solid metal material from which the liquid phase part is discharged, wherein the semi-solid metal material inverting device is configured to:

place the table on an upper end side of the container containing the semi-solid metal material in the semi-solid metal material manufacturing device; and invert the container together with the table and place the inverted container in the temporary storage space through the table, placing the semi-solid metal material on the table, and when the container is inverted, the opening of the table allows the liquid phase part of the semi-solid metal material to be discharged from the container.

2. The press forming system for a semi-solid metal material according to claim 1, further comprising a device for cooling, when the semi-solid metal material manufacturing device manufactures the semi-solid metal material in the container, the semi-solid metal material under a state in which a cooling cover is held in contact with an upper surface side of the semi-solid metal material, and retracting the cooling cover after the cooling for a predetermined period of time.

3. The press forming system for a semi-solid metal material according to claim 2, wherein the cooling cover is placed in contact with the upper surface of the semi-solid metal material so as to cool at least a vicinity of a radial center portion on the upper surface side of the semi-solid metal material.

* * * * *